US008142974B2

(12) United States Patent
Ueno et al.

(10) Patent No.: US 8,142,974 B2
(45) Date of Patent: Mar. 27, 2012

(54) LIQUID DEVELOPER AND IMAGE FORMING APPARATUS

(75) Inventors: Yoshihiro Ueno, Shiojiri (JP); Takashi Teshima, Shiojiri (JP); Masahiro Oki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 496 days.

(21) Appl. No.: 12/405,523

(22) Filed: Mar. 17, 2009

(65) Prior Publication Data

US 2009/0238606 A1 Sep. 24, 2009

(30) Foreign Application Priority Data

Mar. 19, 2008 (JP) ..... 2008-072576
Aug. 25, 2008 (JP) ..... 2008-215834

(51) Int. Cl.
*G03G 9/12* (2006.01)

(52) U.S. Cl. ..... 430/115; 430/112; 430/114

(58) Field of Classification Search ..... 430/155, 430/112, 114, 115
See application file for complete search history.

(56) References Cited

U.S. PATENT DOCUMENTS 3,772,199 A * 11/1973 Tamai et al. ..... 430/115
5,689,779 A * 11/1997 Miyamoto et al. ..... 399/237
5,981,133 A * 11/1999 Miyamoto et al. ..... 430/114
5,981,134 A * 11/1999 Miyamoto et al. ..... 430/115
7,858,284 B2 * 12/2010 Oki et al. ..... 430/114
2006/0166126 A1 * 7/2006 Iwase et al. ..... 430/114
2007/0202431 A1 * 8/2007 Miura et al. ..... 430/115

FOREIGN PATENT DOCUMENTS

JP 10-083100 3/1998

* cited by examiner

*Primary Examiner* — Hoa V Le
(74) *Attorney, Agent, or Firm* — DLA Piper LLP (US)

(57) ABSTRACT

A liquid developer is provided. The liquid developer comprises an insulation liquid, toner particles dispersed in the insulation liquid, a dispersant dissolved in the insulation liquid; and a charge control agent dissolved in the insulation liquid. The charge control agent is represented by the following chemical formula (I):

(I)

wherein in the chemical formula (I) R1 represents an alkyl group or alkenyl group having a carbon number in the range of 8 to 22, and R2 represents a hydroxyalkyl group. The liquid developer has both superior dispersibility and a charge characteristic of toner particles. Further, an image forming apparatus is also provided.

4 Claims, 2 Drawing Sheets

LIQUID DEVELOPER AND IMAGE FORMING APPARATUS

CROSS-REFERENCE TO RELATED APPLICATION

This application claims priorities to Japanese Patent Applications No. 2008-072576 filed on Mar. 19, 2008 and No. 2008-215834 filed on Aug. 25, 2008 which are hereby expressly incorporated by reference herein in their entireties.

BACKGROUND

1. Technical Field

The present invention relates to a liquid developer and an image forming apparatus, and in particular relates to a liquid developer and an image forming apparatus that can use the liquid developer.

2. Related Art

As a developer used for developing an electrostatic latent image formed on a latent image carrier, there is known a liquid developer. In the liquid developer, toner particles formed of a material containing a coloring agent such as a pigment or the like and a binder resin are dispersed into a carrier liquid (insulation liquid) having electric insulation properties.

Generally, a polyester resin is used as the binder resin of the toner particles. Such a polyester resin has high transparency. Therefore, in the case where the polyester resin is used as the binder resin, images obtained by using the liquid developer have superior color development and a high fixing characteristic.

In the meantime, a dispersant is added to a conventional liquid developer for the purpose of improving dispersibility of toner particles contained in the conventional liquid developer (one example of such a liquid developer is disclosed in JP-A-10-83100).

In the case where the dispersant is added to the conventional liquid developer, the dispersibility of the toner particles is improved. However, there is a problem in that a charge characteristic of the toner particles is lowered.

In order to solve the problem, a charge control agent such as a metallic soap and the like is added to the conventional liquid developer, thereby improving the charge characteristic thereof. However, in the case where the charge control agent such as the metallic soap and the like is used in the conventional liquid developer, an insulation property of the insulation liquid is lowered, so that a charge characteristic of the toner particles is lowered.

Therefore, it is difficult for a conventional liquid developer to improve both dispersibility and a charge characteristic of toner particles contained therein.

SUMMARY

Accordingly, it is an object of the present invention to provide a liquid developer which has both superior dispersibility and a charge characteristic of toner particles. Further, it is also another object of the present invention to provide an image forming apparatus that can use such a liquid developer.

These objects are achieved by the present invention described below.

In a first aspect of the present invention, there is provided a liquid developer. The liquid developer comprises an insulation liquid, toner particles dispersed in the insulation liquid, a dispersant dissolved in the insulation liquid, and a charge control agent dissolved in the insulation liquid.

The charge control agent is represented by the following chemical formula (I).

(I)

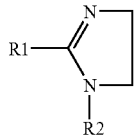

In the chemical formula (I), R1 represents an alkyl group or alkenyl group having a carbon number in the range of 8 to 22, and R2 represents a hydroxyalkyl group.

In the liquid developer according to the present invention, it is preferred that the dispersant includes a polymer dispersant having a 12-hydroxystearic skeleton in a chemical structure thereof.

In the liquid developer according to the present invention, it is also preferred that the hydroxyalkyl group represented by R2 in the chemical formula (I) has a carbon number in the range of 1 to 4.

In the liquid developer according to the present invention, it is also preferred that the toner particles are constituted of a material containing a polyester resin.

In the liquid developer according to the present invention, it is also preferred that the insulation liquid contains a vegetable oil.

In the liquid developer according to the present invention, it is also preferred that the insulation liquid contains a fatty acid monoester.

In a second aspect of the present invention, there is provided an image forming apparatus. The image forming apparatus comprises: a plurality of developing sections that form a plurality of monochromatic color images using a plurality of liquid developers of different colors; an intermediate transfer section to which the plurality of monochromatic color images formed by the developing sections are sequentially transferred to form an intermediate transfer image which is formed by overlaying the transferred monochromatic color images one after another; a secondary transfer section that transfers the intermediate transfer image onto a recording medium to form an unfixed image onto the recording medium; and a fixing device that fixes the unfixed image onto the recording medium.

Each of the plurality of liquid developers of different colors comprises an insulation liquid, toner particles dispersed in the insulation liquid, a dispersant dissolved in the insulation liquid, and a charge control agent dissolved in the insulation liquid.

The charge control agent is represented by the following chemical formula (I).

(I)

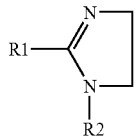

In the chemical formula (I), R1 represents an alkyl group or alkenyl group having a carbon number in the range of 8 to 22, and R2 represents a hydroxyalkyl group.

In the image forming apparatus according to the present invention, it is preferred that each of the plurality of developing sections includes an application roller, a supply section for supplying the liquid developer to form the monochromatic color image onto the application roller, a collecting section for collecting the liquid developer, and a partition for partitioning between the supply section and the collecting section.

In the case where the liquid developer in the supply section includes an excess liquid developer, the excess liquid developer is adapted to be collected from the supply section into the collecting section over the partition.

According to the liquid developer, it is possible to provide a liquid developer which has both superior dispersibility and the charge characteristic of toner particles. Further, it is also possible to provide an image forming apparatus that can use such a liquid developer.

DESCRIPTION OF EXEMPLARY EMBODIMENTS

Figure 1:
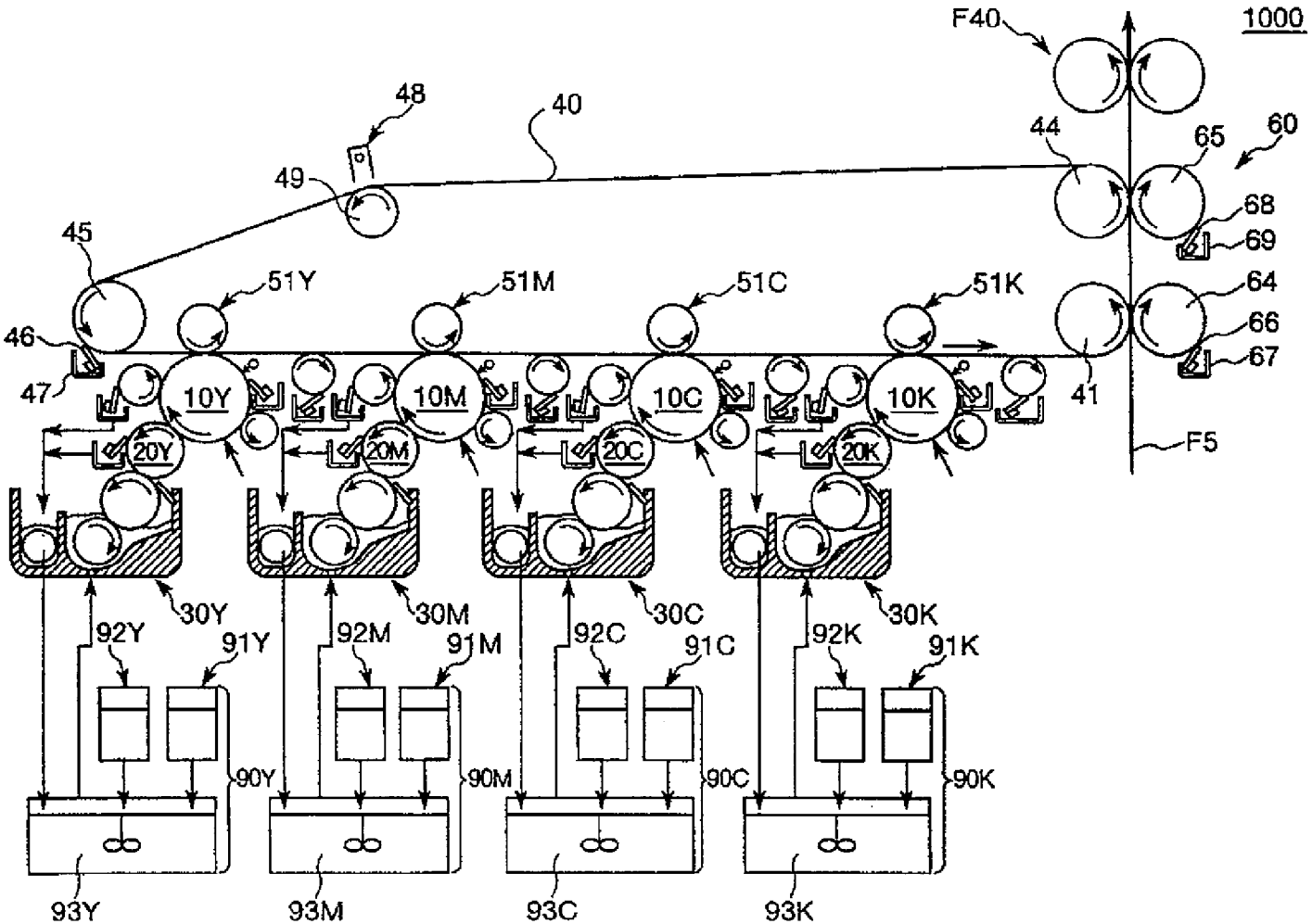
FIG. 1 is a schematic view which shows a preferred embodiment of an image forming apparatus that can use a liquid developer of the present invention.

Hereinbelow, with reference to the accompanying drawings, a preferred embodiment of a liquid developer and an image forming apparatus according to the present invention will be described in details.

Liquid Developer

First, a description will be made with regard to the liquid developer of the present invention.

The liquid developer of the present invention includes an insulation liquid, toner particles dispersed in the insulation liquid, a dispersant for improving dispersibility of the toner particles in the insulation liquid, and a charge control agent having a predetermined chemical structure.

Charge Control Agent

First, a description will be made with regard to the charge control agent.

In the present invention, a compound represented by the following chemical formula (I) is used as the charge control agent.

Chemical formula (I)

(I)

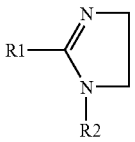

In the chemical formula (1), R1 represents an alkyl group or alkenyl group having a carbon number in the range of 8 to 22, and R2 represents a hydroxyalkyl group.

In the meantime, a dispersant is added to a conventional liquid developer for the purpose of improving dispersibility of toner particles contained therein. In the case where the dispersant is added to the conventional liquid developer, the dispersibility of the toner particles is improved. However, there is a problem in that a charge characteristic of the toner particles is lowered.

In order to solve the problem, a charge control agent such as a metallic soap and the like is added to the conventional liquid developer, thereby improving the charge characteristic thereof. However, in the case where the charge control agent such as the metallic soap and the like is used in the conventional liquid developer, an insulation property of the insulation liquid is lowered, so that charge the of the toner particles is lowered.

Therefore, it is difficult for a conventional liquid developer to improve both dispersibility and a charge characteristic of toner particles contained therein.

In contrast, in the present invention, by using both the charge control agent represented by the chemical formula (I) and the dispersant, it is possible for the liquid developer to enjoy both a superior charge characteristic (in particular, positive charge property) and dispersibility of the toner particles.

Concretely, the compound represented by the chemical formula (I) as the charge control agent has an alkyl group or alkenyl group having a relatively large number of carbon atoms. Therefore, the compound has high compatibility with the insulation liquid (in particular, a vegetable oil and a fatty acid monoester) as described later. In other words, the charge control agent represented by the chemical formula (I) has high solubility to the insulation liquid.

Further, the compound has the hydroxyalkyl group which has high affinity to a resin material (in particular, a polyester resin) constituting the toner particles. Therefore, if the charge control agent represented by the chemical formula (I) is added to the insulation liquid, the charge control agent is reliably dissolved into the insulation liquid, thereby reliably adhering or adsorbing to the surfaces of the toner particles.

The compound has a nitrogen atom to which the hydroxyalkyl group having a high electron-withdrawing property is bonded. The nitrogen atom can attract charged matters, e.g. a proton ($H^+$), contained in the liquid developer. Therefore, by attracting the charged matters contained in the liquid developer to the nitrogen atom in a state that the charge control agent adheres to the surfaces of the toner particles as described above, it is possible to improve a charge characteristic, namely a positively charge property, in the liquid developer.

The compound has another nitrogen atom other than the nitrogen atom as described above. Another nitrogen atom also has a property that attracts charged matters contained in the liquid developer thereto with ease. Therefore, it is possible to improve the charge characteristic, namely the positively charge property, in the liquid developer.

The compound as described above has a five member ring which is constituted of the nitrogen atom, another nitrogen atom, and three carbon atoms. Therefore, it is considered that the charged matters attracted to the nitrogen atoms of the compound, which are contained in the liquid developer, can be reliably retained in a molecular of the compound. As a result, a superior charge characteristic can be exhibited stably.

Further, since the compound as the charge control agent adheres (adsorbs) to the surfaces of the toner particles as described above relatively firmly, the compound is hardly freed in the insulation liquid in a state of an elementary substance thereof. Therefore, it is possible to keep an insulation property of the insulation liquid.

In the chemical formula (I), the carbon number of the alkyl group or alkenyl group represented by R1 is preferably in the range of 8 to 22, and more preferably in the range of 15 to 20. This makes it possible to enjoy superior compatibility to the insulation liquid. Further, in the case where R1 represents the alkenyl group, the charge control agent can exhibit more high compatibility with the vegetable oil and the fatty acid monoester constituting the insulation liquid as described later.

Furthermore, in the chemical formula (I), R2 represents the hydroxyalkyl group. A carbon number of the hydroxyalkyl group is preferably in the range of 1 to 4, and more preferably in the range of 1 to 2. This makes it possible to conspicuously exhibit a property that attracts the charged matters contained in the liquid developer to the nitrogen atom to which the hydroxyalkyl group is bonded. As a result, it is possible to exhibit a superior charge characteristic (positively charge property).

An amount of the charge control agent contained in the liquid developer is preferably in the range of 0.5 to 7.5 parts by weight, and more preferably in the range of 1 to 2 parts by weight with respect to 100 parts by weight of the toner particles. This makes it possible to efficiently improve the positively charge property of the liquid developer.

Dispersant

Next, a description will be made on the dispersant contained in the liquid developer of the present invention.

The dispersant used in the present invention is not limited to a specific material, and it is possible to use the known dispersant.

In the present invention, it is preferred that a polymer dispersant having a 12-hydroxystearic skeleton in a chemical structure thereof is used as the dispersant. The polymer dispersant having such a 12-hydroxystearic skeleton has high compatibility with the insulation liquid (in particular, the vegetable oil and the fatty acid monoester). Therefore, the polymer dispersant can be reliably dissolved into the insulation liquid.

Further, since the 12-hydroxystearic skeleton has high affinity to the resin material (in particular, the polyester resin) constituting the toner particles, it is possible to reliably allow the polymer dispersant to adhere to the surfaces of the toner particles. By doing so, the polymer dispersant is hardly freed in the insulation liquid in a state of an elementary substance thereof, so that a high insulation property of the insulation liquid is maintained. Therefore, it is possible to obtain both superior dispersibility and a charge characteristic of the toner particles.

Since the polymer dispersant having the 12-hydroxystearic skeleton has a long main chain in a chemical structure thereof, the polymer dispersant has a great chance in contacting with the surfaces of the toner particles. Therefore, the polymer dispersant can adhere or adsorb to the surfaces of the toner particles firmly. As a result, it is possible to improve dispersiblity of the toner particles in the insulation liquid.

Examples of the polymer dispersant having the 12-hydroxystearic skeleton include Solsperse 11200 and Solsperse 13940 ("Solsperse" is a product name of Lubrizol Japan Ltd.) and the like.

An amount of such a polymer dispersant having the 12-hydroxystearic skeleton contained in the liquid developer is preferably in the range of 1 to 7 parts by weight with respect to 100 parts by weight of the toner particles, and more preferably in the range of 1.25 to 5 parts by weight with respect to 100 parts by weight of the toner particles. If the amount of the polymer dispersant falls within above noted range, it is possible to more efficiently improve both dispersibility and the positively charge property of the toner particles.

Toner Particles

First, a description will be made with regard to the toner particles.

Constituent Material of Toner Particles (Toner Material)

The toner particles (toner) contained in the liquid developer of the present invention are constituted of a binder resin (resin material) as a main component thereof.

1 Resin Material (Binder Resin)

In the present invention, the resin material is not limited to a specific material, and it is possible to use the known resin.

It is preferred that the resin material includes a polyester resin. Since the polyester resin has high affinity to the charge control agent as described above, the polyester resin can allow the charge control agent to firmly adhere or adsorb to the surfaces of the toner particles, and therefore the positively charge property of the toner particles can be improved.

Further, since a chemical structure of the resin material is similar to the chemical structure of the polymer dispersant having the 12-hydroxystearic skeleton, the resin material has especially high affinity to the polymer dispersant having the 12-hydroxystearic skeleton. As a result, it is possible to allow a large amount of the polymer dispersant to adhere to the surfaces of the toner particles, thereby obtaining both high dispersibility and a charge characteristic of the toner particles.

Furthermore, it is preferred that the polyester resin contains a first polyester resin having a low molecular weight of which weight-average molecular weight $Mw_1$ is in the range of 3,000 to 12,000 and a second polyester resin having a high molecular weight of which weight-average molecular weight $Mw_2$ is in the range of 20,000 to 400,000.

This makes it possible to reliably prevent aggregation of the toner particles during preservation of the liquid developer. On the other hand, it is also possible to fix the toner particles onto a recording medium at a relatively low temperature during the fixing process.

Further, it is preferred that the first polyester resin having a low molecular weight is synthesized from a monomer component which contains at least one of ethylene glycol (EG) and neo-penthyl glycol (NPG).

In this case, if an amount of the ethylene glycol in the monomer component is defined as W (EG) (wt %) and an amount of the neo-penthyl glycol in the monomer component is defined as W (NPG) (wt %), a weight ratio W (EG)/W (NPG) between the amounts of the ethylene glycol and the neo-penthyl glycol which are used in synthesizing the first polyester resin having a low molecular weight is preferably in the range of 0 to 1.1, and more preferably in the range of 0.8 to 1.0.

This makes it possible to exhibit superior preservability or storage stability of the toner particles sufficiently. Further, it is possible to reliably fix the toner particles onto a recording medium at a low temperature. Furthermore, such a liquid developer can be reliably used for forming images at a high speed.

A glass transition temperature $Tg_1$ of the first polyester resin is preferably in the range of 30 to 55° C., and more preferably in the range of 35 to 50° C. If the first polyester resin of which glass transition temperature $Tg_1$ falls within the above noted range is used as the resin material of the toner particles, it is possible to reliably prevent or suppress aggregation and fusion of the toner particles during the preservation of the liquid developer.

As a result, it is possible to exhibit superior preservability or storage stability of the liquid developer. Furthermore, it is also possible to reliably fix the toner particles onto a recording medium at a low temperature.

A softening point T1/2 of the first polyester resin is preferably in the range of 60 to 120° C., and more preferably in the range of 80 to 110° C. If the first polyester resin of which softening point T1/2 falls within the above noted range is used as the resin material of the toner particles, it is possible to reliably prevent or suppress aggregation and fusion of the toner particles during the preservation of the liquid developer.

As a result, it is possible to exhibit superior preservability or storage stability of the liquid developer. Further, during fixing process it is also possible to fuse the toner particles with a small amount of heat. This makes it possible to reliably fix the toner particles onto a recording medium at a low temperature. Furthermore, such a liquid developer can also be used for forming images at a high speed reliably.

In this specification, it is to be noted that the term "glass transition temperature $Tg_1$" means a temperature obtained as follows.

A sample, namely the first polyester resin is subjected to a differential scanning calorimetry apparatus DSC-220C (manufactured by Seiko Instruments Inc.) under conditions that a sample amount is 10 mg, a temperature raising speed is 10° C./min and a measurement temperature range is in the range of 10 to 150° C. to obtain a chart.

Then, an extended line of a base line to the glass transition temperature in the obtained chart is crossed with a tangent which represents a maximal slop in a curve from a point at which a heat capacity of the sample suddenly changes in the chart to a vertex of a peak of the curve to obtain an intersection point of the tangent and the extended line. The glass transition temperature $Tg_1$ is a temperature at the intersection point.

In this regard, it is to be noted that this description can be applied to a glass transition temperature (Tg) of the polyester resin containing the first polyester resin and the second polyester resin and a glass transition temperature ($Tg_2$) of the second polyester resin as described below.

In this specification, the term "softening point" means a temperature at which softening is begun under the conditions that a temperature raising speed is 5° C./min and a diameter of a die hole is 1.0 mm in a high-floored flow tester (manufactured by Shimadzu Corporation).

Further, in the case where the toner particles contain the polyester resin as a constituent material thereof, an amount of the first polyester resin is preferably in the range of 50 to 90 wt %, and more preferably in the range of 60 to 80 wt %. Namely, the amount of the first polyester resin is larger than the amount of the second polyester resin. This makes it possible to exhibit a superior fixing characteristic at a low temperature as well as superior preservability or storage stability of the liquid developer.

Further, it is preferred that the second polyester resin is synthesized from a monomer component which contains at least one of ethylene glycol (EG) and neo-penthyl glycol (NPG).

In this case, if an amount of the ethylene glycol in the monomer component is defined as W (EG) (wt %) and an amount of the neo-penthyl glycol in the monomer component is defined as W (NPG) (wt %), a weight ratio W (EG)/W (NPG) between the amounts of the ethylene glycol and the neo-penthyl glycol which are used in synthesizing the second polyester resin is preferably in the range of 1.2 to 3.0, and more preferably in the range of 1.5 to 2.0.

This makes it possible for the liquid developer to exhibit superior preservability or storage stability. Further, it is also possible to reliably fix the toner particles onto a recording medium at a low temperature during the fixing process. Furthermore, it is possible to reliably improve both adhesion between the fixed toner particles and the recording medium and weather resistance. As a result, it is also possible to exhibit superior durability of the finally obtained toner images.

A glass transition temperature $Tg_2$ of the second polyester resin is preferably in the range of 45 to 70° C., and more preferably in the range of 50 to 65° C. If the second polyester resin of which glass transition temperature $Tg_2$ falls within the above noted range is used as the resin material of the toner particles, it is possible to reliably prevent or suppress aggregation and fusion of the toner particles during the preservation of the liquid developer. As a result, it is possible to exhibit superior preservability or storage stability of the liquid developer.

In particular, even if the liquid developer is preserved or stored at a high temperature, it is also possible to reliably prevent aggregation or fusion of the toner particles. As a result, it is also possible for the liquid developer to exhibit superior preservability or storage stability at a high temperature. Furthermore, it is also possible to reliably fix the toner particles onto a recording medium at a low temperature.

A softening point T1/2 of the second polyester resin is preferably in the range of 60 to 220° C., and more preferably in the range of 80 to 190° C. If the second polyester resin of which softening point T1/2 falls within the above noted range is used as the resin material of the toner particles, it is possible to prevent or suppress aggregation and fusion of the toner particles reliably during the preservation of the liquid developer.

As a result, it is possible to exhibit superior preservability or storage stability of the liquid developer. On the other hand, during fixing process it is possible to fix the toner particles onto a recording medium at a low temperature more firmly.

A glass transition temperature Tg of the polyester resin containing both the first polyester resin and the second polyester resin as described above is preferably in the range of 35 to 60° C., and more preferably in the range of 40 to 50° C.

If the polyester resin of which glass transition temperature Tg falls within the above noted range is used as a constituent material of the toner particles, it is possible to reliably prevent or suppress aggregation and fusion of the toner particles during the preservation of the liquid developer. As a result, it is possible to exhibit superior preservability or storage stability of the liquid developer. Further, it is also possible to fix the toner particles onto a recording medium at a low temperature more reliably.

Furthermore, in the case where the toner particles contain the polyester resin as a constituent material thereof, an amount of the second polyester resin contained in the polyester resin is preferably in the range of 10 to 50 wt %, and more preferably in the range of 20 to 40 wt %. This makes it possible to exhibit superior preservability or storage stability of the liquid developer. Further, it is also possible to exhibit a superior fixing characteristic at a low temperature.

An amount of the polyester resin (first polyester resin and second polyester resin) contained in the resin material is preferably 50 wt % or higher, and more preferably 80 wt % or higher.

An acid value of the resin material to be used in the present invention is preferably in the range of 5 to 15 mgKOH/g, and more preferably in the range of 5 to 10 mgKOH/g. This makes it possible to make the dispersant and the charge control agent as described above efficiently adhering to the surface of each of the toner particles. As a result, the liquid developer can obtain both superior dispersibility and a charge characteristic of the toner particles.

A glass transition temperature (Tg) of the resin material as described above is preferably in the range of 15 to 70° C., and more preferably in the range of 20 to 55° C. This makes it possible for the liquid developer containing the toner particles to reliably prevent the toner particles from being agglutinated and fused (adhering to each other) during preservation or storage of the liquid developer As a result, preservability stability of the liquid developer becomes superior. Furthermore, it is possible to reliably fix the toner particles onto a recording medium at a low temperature.

A softening point (T1/2) of the resin material is not limited to a specific value, but is preferably in the range of 50 to 130° C., more preferably in the range of 50 to 120° C., and even more preferably in the range of 60 to 115° C.

2 Coloring Agent

The toner particles of the liquid developer contains a coloring agent in addition to the resin material. As for a coloring agent, it is not particularly limited to a specific material, but known pigments, dyes or the like can be used.

3 Other Components

In the toner particles, additional components other than the above components may be contained. Examples of such other components include wax, magnetic powder, and the like.

Shape of Toner Particles

An average particle size (diameter) of the toner particles constituted from the above described materials is preferably in the range of 0.7 to 3 μm, and more preferably in the range of 1 to 2.5 μm.

If the average particle size of the toner particles is within the above range, it is possible to make variation in properties of the toner particles small. As a result, it is possible to make resolution of a toner image formed from the liquid developer (liquid toner) sufficiently high while making the reliability of the obtained liquid developer as a whole sufficiently high.

Further, it is also possible to improve dispersibility of the toner particles in the liquid developer to a satisfactory level, thereby making the preservability or storage stability of the liquid developer excellent.

In this regard, it is to be noted that the term "average diameter" means an average diameter of particles each having a reference volume.

An amount of the toner particles contained in the liquid developer is preferably in the range of 10 to 60 wt %, and more preferably in the range of 20 to 50 wt %.

Insulation Liquid

Next, a description will be made with regard to the insulation liquid.

In the present invention, various insulation liquids can be used as long as they have sufficiently high insulation properties. In more details, an electric resistance of such insulation liquids as described above at room temperature (20° C.) is preferably equal to or higher than $1\times10^{11}$ Ωcm, more preferably equal to or higher than $1\times10^{12}$ Ωcm, and even more preferably equal to or higher than $1\times10^{13}$ Ωcm.

Examples of the insulation liquid that satisfy these conditions include: an mineral oil such as ISOPAR E, ISOPAR G, ISOPAR H, ISOPAR L ("ISOPAR" is a product name of Exxon Mobil), SHELLSOL 70, SHELLSOL 71 ("SHELLSOL" is a product name of Shell Oil), Amsco OMS, Amsco 460 solvent ("Amsco" is a product name of Spirit Co., Ltd.), low-viscosity or high-viscosity liquid paraffin (Wako Pure Chemical Industries, Ltd.), and the like; a vegetable oil which contains a fatty acid glyceride, medium fatty acid ester, and the like; a fatty acid monoester which is a ester of a fatty acid and a monoalcohol; octane, isooctane, decane, isodecane, decaline, nonane, dodecane, isododecane, cyclohexane, cyclooctane, cyclodecane, benzene, toluene, xylene, mesitylene, and the like. These insulation liquids may be used singly or in combination of two or more of them.

Among the above-mentioned insulation liquids, the vegetable oil is preferably used, since the vegetable oil has superior affinity (compatibility) with charge control agent described above. Therefore, use of such vegetable oil as the insulation liquid makes it possible to reliably dissolve the charge control agent in the insulation liquid.

As a result, it is possible to obtain a superior charge characteristic of the toner particles. Further, since the vegetable oil has superior compatibility with the polymer dispersant having the 12-hydroxystearic skeleton, it is possible to improve dispersibility of the toner particles.

Furthermore, it is possible to prevent variations in the charge characteristic from being made large. Furthermore, the vegetable oil is a component which is harmless to the environment. Therefore, it is possible to decrease leakage of the insulation liquid to the outside of the image forming apparatus and a load to the environment by the insulation liquid which may occur by disposal of the used liquid developer. As a result, the invention can provide a liquid developer which is harmless to the environment.

Further, among the insulation liquids mentioned above, the fatty acid monoester is preferably used, since the fatty acid monoester has superior compatibility with charge control agent as described above in a same manner as the vegetable oil. Therefore, use of such a fatty acid monoester as the insulation liquid makes it possible to reliably dissolve the charge control agent in the insulation liquid.

As a result, it is possible to obtain a superior charge characteristic of the toner particles. Further, since the fatty acid monoester has superior compatibility with the polymer dispersant having the 12-hydroxystearic skeleton, it is possible to improve dispersibility of the toner particles. In particular, by using both the fatty acid monoester and the vegetable oil as the insulation liquid, it is possible to conspicuously obtain the effects described above.

Furthermore, the fatty acid monoester has an effect of plasticizing the toner particles during the fixing process (plasticizing effect). The plasticized toner particles can adhere to a recording medium with ease, so that it is possible to exhibit a high fixing property of the toner particles. In particular, by plasticizing the toner particles, the charge control agent and the dispersant as described above can firmly adhere (adsorb) to the surfaces of the toner particles, thereby further improving a charge characteristic and dispersibility of the toner particles.

Examples of such a fatty acid monoester to be used as the insulation liquid include: an alkyl (methyl, ethyl, propyl, butyl, or the like) monoester of an unsaturated fatty acid which includes oleic acid, palmitoleic acid, linolic acid, α-linolenic acid, γ-linolenic acid, arachidonic acid, docosahexaenoic acid (DHA), eicosapentaenoic acid (EPA), and the like; an alkyl (methyl, ethyl, propyl, butyl, or the like) monoester of a saturated fatty acid which includes butyric acid, caproic acid, caprylic acid, capric acid, lauric acid, myristic acid, palmitic acid, stearic acid, arachidic acid, behenic acid, lignoceric acid, and the like; and the like. These fatty acid monoesters may be used singly or in combination of two or more of them.

In the case where the fatty acid monoester is contained in the insulation liquid, an amount of the fatty acid monoester contained therein is preferably in the range of 1 to 50 wt %, and more preferably in the range of 5 to 45 wt %. This makes it possible to improve dispersibility of the toner particles. It is also possible to reliably prevent ununiform charge of the toner particles from occurring.

The viscosity of the insulation liquid is not particularly limited to a specific value, but it is preferably in the range of 5 to 1000 mPa·s, more preferably in the range of 50 to 800 mPa·s, and even more preferably in the range of 50 to 500 mPa·s.

If the viscosity of the insulation liquid falls within the above range, in the case where the liquid developer is dipped from a developer container by an application roller in an image forming apparatus, an appropriate amount of the insulation liquid can adhere to the surfaces of the toner particles. As a result, the liquid developer can have superior developing efficiency and transferring efficiency and the like.

Further, it is possible to make dispersibility of the toner particles in the insulation liquid higher. Furthermore, in the image forming apparatus, it is possible to supply the liquid developer to the application roller more uniformly as well as to prevent dripping of the liquid developer due to an appropriate viscosity of the liquid developer.

Additionally, this makes it possible to prevent aggregation or settling of the toner particles efficiently. As a result, it is possible to make dispersibility of the toner particles in the insulation liquid higher.

On the other hand, if the viscosity of the insulation liquid as described above is smaller than the lower limit value described above, there is a possibility that dripping of the liquid developer and the like occurs in the image forming apparatus.

Further, if the viscosity of the insulation liquid as described above exceeds the upper limit value described above, there is a case that sufficient dispersibility of the toner particles can not be obtained in the insulation liquid. As a result, there is a case that it is not possible to supply the liquid developer to the application roller uniformly in the image forming apparatus as described later.

In this regard, it is to be noted that in this specification, the viscosity of the insulation liquid is measured at a temperature of 25° C.

Further, the liquid developer (insulation liquid) may further contain known antioxidant, charge control agent, and the like in addition to components as described above.

Method of Producing Liquid Developer

Hereinbelow, a preferred embodiment of a method of producing the liquid developer of the present invention will be described.

The method of producing the liquid developer in this embodiment includes a step of preparing a dispersion liquid comprised of a water-based dispersion medium constituted of a water-based liquid and a dispersoid in the form of finely divided particles comprised of a resin material and a coloring agent described above. The dispersoid is dispersed in the water-based dispersion medium.

The method further includes an associated particle formation step of associating a plurality of particles of the dispersoid in the water-based dispersion medium to obtain the associated particles dispersed in an associated particle dispersion liquid.

The method further includes a step of removing a liquid (solvent) contained in the associated particle dispersion liquid to obtain toner particles comprised of the resin material and the coloring agent.

The method further includes a dispersion step of dispersing the thus obtained toner particles, a charge control agent and a dispersant similar to that as described above in an insulation liquid.

Hereinbelow, each of the steps of the method of producing the liquid developer of this embodiment will be described in detail.

Step of Preparing Dispersion Liquid (Step of Preparing Water-Based Dispersion Liquid)

First, a dispersion liquid (water-based dispersion liquid) is produced as described below.

Such a method of production of the water-based dispersion liquid is not particularly limited. An example of such a method is described hereinbelow.

First, a resin solution containing an organic solvent and a constituent material of toner particles (toner material) which is a resin material (e.g. a polyester resin and a resin other than the polyester resin), a coloring agent and the like is obtained by dissolving or dispersing the constituent material of the toner particles in the organic solvent (Preparation of Resin Solution).

Thereafter, a water-based liquid is added to the resin solution described above. As a result, it is possible to obtain the water-based dispersion liquid comprised of the water-based liquid (water-based dispersion medium) and a dispersoid comprised of the constituent material of toner particles in the form of fine particles which is dispersed in the water-based liquid (Formation of Dispersoid).

Preparation of Resin Solution

First, the constituent material of the toner particles is dissolved and/or dispersing in the organic solvent. As a result, the resin solution containing the organic solvent and the constituent material is obtained.

The resin solution contains the constituent material of the toner particles and the organic solvent as follow.

Various organic solvents may be employed as long as they can dissolve a part of the resin material of the toner particles, but it is preferable to use an organic solvent having a boiling point lower than that of the water-based liquid. This makes it possible to remove the solvent from the dispersoid easily.

Further, it is also preferred that the organic solvent has low compatibility with the water-based dispersion medium (for example, a liquid having a solubility of 30 g or lower with respect to the water-based liquid of 100 g at 25° C.). This makes it possible for the toner material to be finely dispersed in the water-based dispersion medium in a stable manner.

Further, a composition of the organic solvent can be selected appropriately according to the resin material described above, the composition of the coloring agent to be used, the composition of the water-based dispersion medium to be used or the like.

Such an organic solvent is not particularly limited to any specific kinds of solvent. Examples of such an organic solvent include ketone solvent such as methyl ethyl ketone (MEK), aromatic hydrocarbon solvent such as toluene, and the like.

Such a resin liquid can be obtained by mixing the resin material, the coloring agent, the organic solvent and the like with being stirred with an agitator and the like. Examples of such an agitator include high speed agitators such as DESPA (produced by ASADA IRON WORKS. CO., LTD), T.K. ROBOMIX/T.K. HOMO DISPER MODEL 2.5 (produced by PRIMIX Corporation).

Further, the temperature of the components constituting the resin liquid in stirring the components with the agitator is preferably in the range of 20 to 60° C., and more preferably in the range of 30 to 50° C.

An amount of a solid component contained in the resin solution is not particularly limited to a specific value, but it is preferably in the range of 40 to 75 wt %, more preferably in the range of 50 to 73 wt %, and even more preferably in the range of 50 to 70 wt %. If the amount of the solid component falls within above noted range, it is possible to increase the degree of sphericity of the fine particles of the dispersoid in the water-based dispersion liquid.

Namely, it is possible to form the shape of the dispersoid into an approximately spherical shape. As a result, the toner particles in the finally obtained liquid developer can have especially large roundness and especially small particle shape variation so that the toner particles are preferably used in a liquid developer.

Further, in the preparation of the resin solution, the all components constituting the resin solution may be mixed at the same time. Furthermore, a part of the components constituting the resin solution is mixed thereby to obtain a mixture (master). Thereafter, the mixture may be mixed with the other components thereof.

Formation of Dispersoid

Next, a water-based dispersion liquid (dispersion liquid) is prepared.

The water-based dispersion medium constituted from the water-based liquid is added to the resin solution described above. As a result, a dispersoid comprised of fine particles of the toner material described above is formed in the water-based dispersion medium so that a water-based dispersion liquid (a dispersion liquid) in which the dispersoid is dispersed is obtained.

In this embodiment, the water-based dispersion medium is constituted from a water-based liquid.

As the water-based liquid, a liquid constituted from water as a major component thereof can be used.

Further, the water-based liquid may contain a solvent having good compatibility with water (for example, a solvent having a solubility of 50 g or higher with respect to water of 100 g at 25° C.).

Furthermore, in preparing the water-based dispersion liquid, an emulsion dispersant may be added to the water-based dispersion medium. By adding the emulsion dispersant to the water-based dispersion medium in preparing the water-based dispersion liquid, it is possible to produce the water-based dispersion liquid more easily.

Such an emulsion dispersant is not particularly limited to a specific material, but commonly used emulsion dispersants can be used.

Further, the water-based dispersion liquid may contain a neutralizing agent. By containing the neutralizing agent in the water-based dispersion liquid in preparing the water-based dispersion liquid, the neutralizing agent neutralizes functional groups (for example, a carboxyl group) contained in a resin material constituting the toner particles.

As a result, it is possible to improve the dispersibility of the dispersoid. Further, it is also possible to make variations in shape and size of the dispersoid in the water-based dispersion liquid smaller, and also possible to make particle size distribution of the toner particles finally obtained especially narrow.

The neutralizing agent may be added to the water-based dispersion liquid. Further, the neutralizing agent may be added to the resin liquid. Furthermore, in preparing the water-based dispersion liquid, the neutralizing agent may be added to the water-based dispersion liquid at different timings.

As for the neutralizing agent, a basic compound may be used. More specifically, examples of such a neutralizing agent include: inorganic base such as sodium hydroxide, potassium hydroxide, ammonia, and the like; organic base such as diethylamine, triethylamine, isopropylamine, and the like. These neutralizing agents may be used singly or in combination of two or more of them. Further, the neutralizing agent may be consisted of aqueous solution containing the compounds described above.

Further, in the case where the water-based dispersion liquid contains the basic compound as the neutralizing agent, an amount of using the basic compound is preferably in the range of 1 to 3 times equivalent amount of the basic compound which is necessary to neutralize all the carboxyl groups contained in the resin material in the water-based dispersion liquid, and more preferably in the range of 1 to 2 times equivalent amount of the basic compound.

This makes it possible to make the shape of each particles of the dispersoid uniform. Further, this also makes it possible to narrow particle size distribution of the toner particles finally obtained.

Such a method of adding the water-based liquid to the resin solution is not particularly limited to a specific method, but it is preferred that the water-based liquid containing water is added to the resin solution with being stirred. More specifically, it is preferred that the water-based liquid is added drop by drop to the resin solution with the resin solution being stirred by an agitator and the like thereby to induce phase-inversion from a water-in-oil type emulsified liquid to an oil-in-water type emulsified liquid.

As a result, the water-based dispersion liquid in which the dispersoid derived from the resin liquid is dispersed in the water-based liquid (the water-based dispersion liquid) is finally obtained.

Examples of such an agitator for stirring the resin solution include high speed agitators such as DESPA (produced by ASADA IRON WORKS. CO., LTD), T.K. ROBOMIX/T.K. HOMO DISPER MODEL 2.5 (produced by PRIMIX Corporation), CAVITRON (produced by MITUI MINING. CO., LTD), Slasher (produced by EUROTECH, LTD) and the like, or high speed dispersers.

Further, in adding the water-based liquid to the resin solution, a rotational velocity of the tip of a stirring blade of the agitator described above is preferably in the range of 10 to 20 m/sec, and more preferably in the range of 12 to 18 m/sec. This makes it possible to produce the water-based dispersion liquid efficiently.

Further, it is also possible to make variations in shape and size of the dispersoid in the water-based dispersion liquid especially small. Furthermore, it is also possible to prevent the dispersoid in the water-based dispersion liquid from being formed into excessively fine particles or coarsened particles, and also possible to improve the dispersibility of the dispersoid.

An amount of the solid component contained in the water-based dispersion liquid is not particularly limited to a specific value, but it is preferably in the range of 5 to 55 wt %, and more preferably in the range of 10 to 50 wt %. This makes it possible to prevent bonding or aggregation of the dispersoid in the water-based dispersion liquid more reliably, thereby enabling productivity of the toner particles (liquid developer) to be especially excellent.

Further, the temperature of the components constituting the water-based dispersion liquid in stirring the components with the agitator is preferably in the range of 20 to 60° C., and more preferably in the range of 20 to 50° C.

Associated Particle Formation Step

Next, a plurality of the fine particles of the dispersoid in the water-based dispersion liquid are associated so that associated particles dispersed in an associated particle dispersion liquid is obtained (Associated particle formation). Association of the fine particles of dispersoid is generally carried out by allowing fine particles of the dispersoid containing organic solvent conflicting with each other and thereby each of the dispersoid being integrated.

The association of a plurality of the dispersoid is carried out by adding an electrolyte to the water-based dispersion liquid obtained by the processes as described above with being stirred. This makes it possible to obtain the associated particles easily and reliably. Further, by controlling an additive amount of the electrolyte into the water-based dispersion liquid, it is possible to control a particle size and a particle size distribution of the associated particles easily and reliably.

Such an electrolyte is not particularly limited to any specific kinds of electrolyte, but organic or inorganic soluble salts may be used singly or in combination of two or more of them.

Further, it is preferred that such an electrolyte is salts of monovalent cation. This makes it possible to make particle size distribution of the associated particles narrow. Further, it is possible to prevent coarsened particles from being produced in the process of associating the fine particles of the dispersoid.

Among the above-mentioned electrolytes, sulfate salts such as sodium sulfate, ammonium sulfate and the like, and carbonate are preferably used as the electrolyte, and the sulfate salts are especially preferably used. This makes it possible to control a particle size of the associated particles especially easily.

An amount of the electrolyte to be added is preferably in the range of 0.5 to 3 parts by weight, more preferably in the range of 1 to 2 parts by weight with respect to 100 parts by weight of the solid component contained in the water-based dispersion liquid. This makes it possible to control a particle size of the associated particles more reliably. Further, it is possible to also prevent production of coarsened particles reliably.

Further, it is preferred that a solution of the electrolyte is added to the water-based dispersion liquid. This makes it possible to make the electrolyte diffuse in the whole water-based dispersion liquid quickly. Furthermore, it is also possible to control the amount of the electrolyte to be added to the water-based dispersion liquid easily and reliably. As a result, it is possible to obtain the associated particles having a desired particle size and especially narrow particle size distribution.

Further, in the case where the solution of the electrolyte is added to the water-based dispersion liquid, concentration of the electrolyte with respect to the solution is preferably in the range of 2 to 10 wt %, and more preferably in the range of 2.5 to 6 wt %. This makes it possible to make the electrolyte diffuse in the whole water-based dispersion liquid especially quickly.

Furthermore, it is also possible to control the amount of the electrolyte to be added to the water-based dispersion liquid easily and reliably. In addition, the amount of water in the water-based dispersion liquid after adding the solution of the electrolyte can be adjusted appropriately.

As a result, a growth rate of the associated particles can be appropriately adjusted to be slow without lowering the productivity. This makes it possible to control a particle size of the associated particles more reliably. Further, it is also possible to prevent coarsened particles from being produced in the water-based dispersion liquid.

Further, in the case where the solution of the electrolyte is added to the water-based dispersion liquid, a rate of adding the solution of the electrolyte to the water-based dispersion liquid is preferably in the range of 0.5 to 10 parts by weight/min, more preferably in the range of 1.5 to 5 parts by weight/min with respect to 100 parts by weight of the solid component contained in the water-based dispersion liquid.

This makes it possible to prevent the concentration of the electrolyte in the whole water-based dispersion liquid from being inhomogeneous. As a result, it is possible to prevent production of coarsened particles reliably.

Further, this makes it possible to control the growth rate of the associated particles more appropriately. As a result, it is possible to control an average particle size of the associated particles more reliably, thereby enabling the productivity of the toner particles (liquid developer) to be especially excellent.

Further, the electrolyte may be added to the water-based dispersion liquid at different timings. This makes it possible to obtain associated particles having a desired particle size and large roundness (sphericity) reliably.

Further, in the step of forming the associated particles, the associated particles in the associated particle dispersion liquid are produced in a state that the water-based dispersion liquid being stirred by an agitator. This makes it possible to make variations in shape and size of the associated particles in the associated particle dispersion liquid especially small.

As a result, variations in a characteristic (in particular, charge characteristic) among the obtained toner particles become small.

Such an agitator for stirring the associated particle dispersion liquid may be equipped with a stirring blade. Examples of such a stirring blade include anchor type stirring blade, turbine blade, Pfaudler blade, FULLZONE impeller, maxblend stirring blade, and semi-lunar blade. Among the above-mentioned stirring blades, maxblend stirring blade and FULLZONE impeller are preferably used as a stirring blade.

This makes it possible to make the electrolyte disperse and dissolve in the water-based emulsion (the associated particle dispersion liquid) more quickly and more homogeneously. Namely, this makes it possible to prevent the concentration of the electrolyte in the water-based emulsion from being inhomogeneous reliably.

Further, this makes it possible to make the dispersoid in the water-based emulsion associated efficiently. Furthermore, it is possible to prevent the associated particles that have been already formed from being collapsed more reliably. As a result, it is possible to obtain associated particles having small variations in shape and size thereof efficiently.

In the step of forming the associated particles, a rotational velocity of the tip of the stirring blade of the agitator described above is preferably in the range of 0.1 to 10 m/sec, more preferably in the range of 0.2 to 8 m/sec, and even more preferably in the range of 0.2 to 6 m/sec.

If the rotational velocity falls within the above noted range, it is possible to make the electrolyte disperse and dissolve in the water-based dispersion liquid (the associated particle dispersion liquid) more quickly and more homogeneously.

Namely, this makes it possible to prevent the concentration of the electrolyte in the water-based dispersion liquid from being inhomogeneous reliably. Further, it is possible to prevent the associated particles that have been already formed from being collapsed more reliably.

An average particle size of the obtained associated particles is preferably in the range of 0.5 to 5 μm, and more preferably in the range of 1.5 to 3 μm. This enables the toner particles finally obtained to have an appropriate particle size.

Step of Removing Solvent in Associated Particle Dispersion Liquid

Next, the organic solvent contained in the associated particle dispersion liquid is removed. This makes it possible to obtain resin fine particles (toner particles) constituted of the toner material.

Such a method of removing the organic solvent in the associated particle dispersion liquid is not particularly limited to a specific method, but for example, it may be carried out by drying the associated particle dispersion liquid under reduced pressure. This makes it possible to prevent the constituent material of the toner particles (that is the resin material) from denaturing sufficiently and also makes it possible to remove the organic solvent efficiently.

Further, a temperature to remove the organic solvent contained in the associated particle dispersion liquid is preferably lower than a glass transition temperature (Tg) of the resin material constituting the associated particles.

Further, in this step of removing the organic solvent contained in the associated particle dispersion liquid, an antifoaming agent may be added to the associated particle dispersion liquid. This makes it possible to remove the organic solvent efficiently.

Examples of an antifoaming agent include mineral oil type antifoaming agent, polyether type antifoaming agent, and silicone type antifoaming agent, lower alcohol, higher alcohol, fat, fatty acid, fatty acid ester, ester phosphate and the like.

An amount of the antifoaming agent to be added is not particularly limited to a specific value, but an amount of the antifoaming agent is preferably in the range of 20 to 300 ppm, and more preferably in the range of 30 to 100 ppm with respect to the solid component contained in the associated particle dispersion liquid.

Further, in this step of removing the organic solvent contained in the associated particle dispersion liquid, a part of the water-based liquid may be removed together with the organic solvent.

In this regard, in this step of removing the organic solvent contained in the associated particle dispersion liquid, a part of the organic solvent may remain in the associated particle dispersion liquid. Even if in this step, a part of the organic solvent remains in the associated particle dispersion liquid, the organic solvent contained in the associated particle dispersion liquid is completely removed in the later step.

Step of Washing

Next, the resin fine particles constituted of the toner material obtained as described above are washed (Step of Washing).

By carrying out the step of washing the toner particles, even if the resin fine particles contain the organic solvent, which has not yet been removed in the previous step, and the like as impurities, the organic solvent and the like contained in the resin fine particles is completely removed in this step. As a result, the toner particles finally obtained have an especially small amount of total volatile organic compounds (TVOC).

Such a method of washing the toner particles is carried out as follow. First, the slurry mainly containing the resin fine particles and the water-based liquid is separated into a solid content (the resin fine particles) and a liquid content.

Thereafter, the solid content separated from the slurry is dispersed into water to thereby obtain new slurry (redispersion step). Further, once more, the thus obtained slurry is separated into a solid content (the resin fine particles) and a liquid content. Further, the separation step and the redispersion step may be repeated more than once.

Step of Drying

Thereafter, the resin fine particles constituted of the toner material washed as described above are dried to thereby obtain toner particles (step of drying).

In this step of drying the resin fine particles, such resin fine particles can be dried by a drying machine. Examples of such a drying machine include a vacuum drier (for example, "Ribocone" produced by Okawara Manufactureing, "Vrieco-Nauta Mixer NXV Vacuum" produced by HOSOKAWA MICRON CORPORATION, and the like), a fluid-bed drier (produced by OKAWARA MFG. Co., Ltd), and the like.

Dispersion Step

Next, the thus obtained toner particles, the charge control agent and the dispersant described above are dispersed in an insulation liquid. As a result, the liquid developer of the present invention is obtained (dispersion step).

Such a method of dispersing the toner particles, the charge control agent, and the dispersant in the insulation liquid is not particularly limited to a specific method, but for example, it may be carried out by mixing all the toner particles, the dispersant, and the insulation liquid with bead mill, ball mill, and the like. This makes it possible to make the charge control agent and the dispersant described above adhere to the toner particles more reliably.

Further, in this step of dispersing the toner particles, the charge control agent and the dispersant in the insulation liquid, additional components constituting the liquid developer other than the toner particles, the charge control agent, the dispersant, and the insulation liquid may be mixed together.

Further, in this step of dispersing the toner particles, the charge control agent, and the dispersant in the insulation liquid, the toner particles, the charge control agent, and the dispersant may be dispersed in the whole of the insulation liquid used in the liquid developer. Alternatively, the toner particles, the charge control agent, and the dispersant may be dispersed in a part of the insulation liquid used in the liquid developer.

In the case where the toner particles, the charge control agent, and the dispersant are dispersed in a part of the insulation liquid used in the liquid developer, the remaining insulation liquid to be added after dispersion of the toner particles, the charge control agent, and the dispersant may be the same kind of the insulation liquid that has been already used.

Alternatively, the remaining insulation liquid to be added after dispersion of the toner particles, the charge control agent, and the dispersant may be a different kind of the insulation liquid that has been already used. In the latter case, it is possible to control the physical characteristic such as viscosity of the liquid developer finally obtained easily.

By using the method of producing the liquid developer as described above, it is possible to make variations in shape and size of the toner particles in the liquid developer small. Further, it is also possible to obtain toner particles of which constituent material is dispersed uniformly. As a result, it is possible to make variations in a charge characteristic among the toner particles small.

Furthermore, since the surface area of each of the toner particles is uniform among the toner particles, it is possible to make the charge control agent and the dispersant described above adhere to the surfaces of the toner particles uniformly. As a result, it is possible to obtain a liquid developer having an excellent charge characteristic and dispersibility of the toner particles.

Image Forming Apparatus

Next, a description will be made with regard to a preferred embodiment of an image forming apparatus of the present invention. The image forming apparatus of the present invention is an apparatus which forms color images on a recording medium by using the liquid developer of the present invention as described above.

Figure 2:
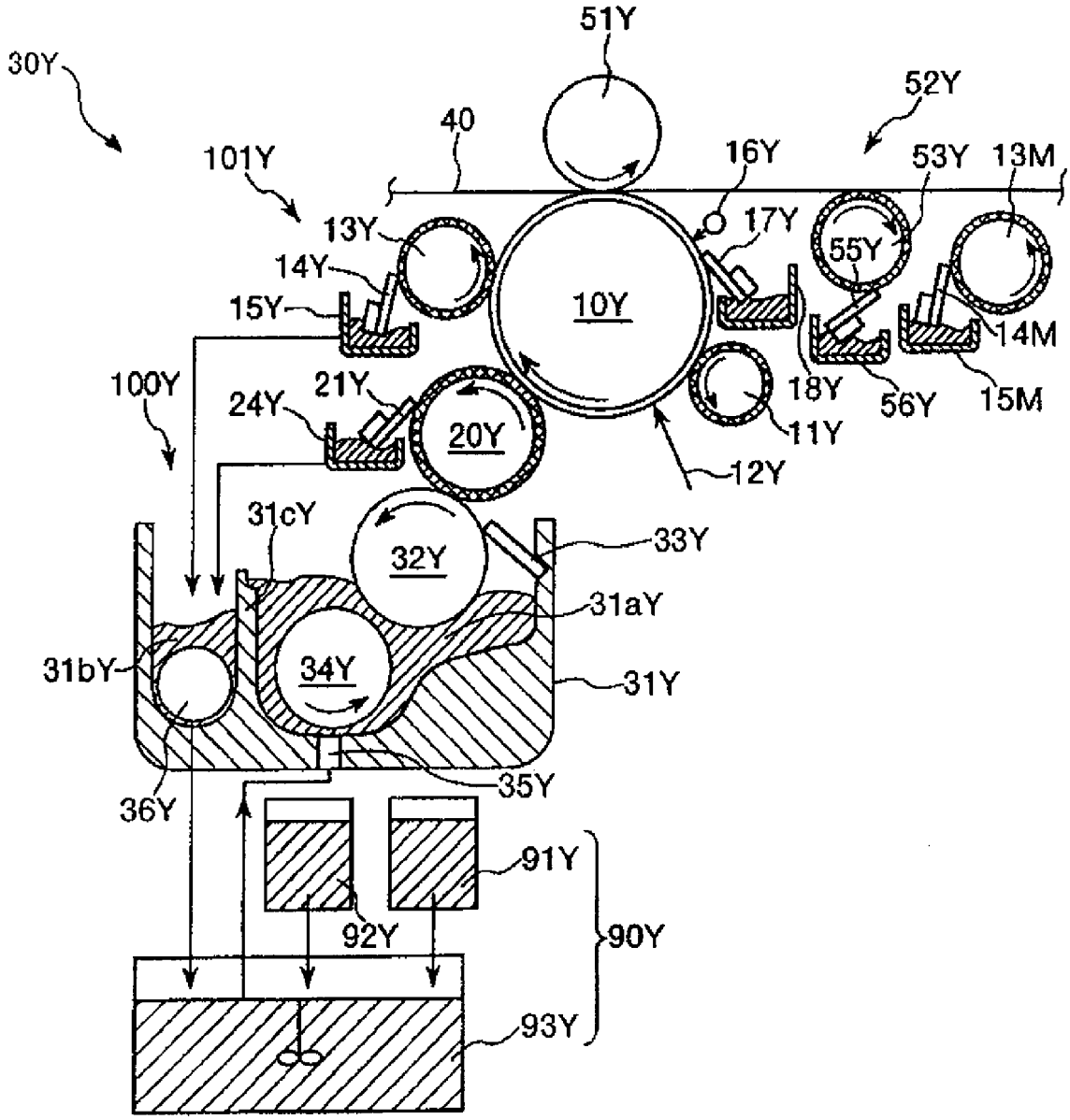
FIG. 2 is an enlarged view of a part of the image forming apparatus shown in FIG. 1.

FIG. 1 is a schematic view which shows a preferred embodiment of an image forming apparatus to which the liquid developer of the present invention can be used. FIG. 2 is an enlarged view of a part of the image forming apparatus shown in FIG. 1.

As shown in FIG. 1 and FIG. 2, the image forming apparatus 1000 includes four developing sections comprised of 30Y, 30C, 30M and 30K, an intermediate transfer section (belt) 40, a secondary transfer unit (secondary transfer section) 60, a fixing section (fixing unit) F40 used in the first embodiment of the image forming apparatus and four liquid developer supply sections 90Y, 90M, 90C and 90K.

The developing sections 30Y, 30C and 30M include respectively a yellow (Y) liquid developer, a cyan (C) liquid developer, and a magenta (M) liquid developer, and have the functions of developing latent images with the liquid developers to form monochromatic color images corresponding to the respective colors. Further, the developing section 30K includes a black (K) liquid developer, and has the function of developing a latent image with the liquid developer to form a black monochromatic image.

The developing sections 30Y, 30C, 30M and 30K have the same structure. Therefore, in the following, the developing section 30Y will be representatively described.

As shown in FIG. 2, the developing section 30Y includes a photoreceptor 10Y which carries a latent image and rotates in the direction of the arrow shown in the drawings. The image forming apparatus 1000 further includes an electrifying roller 11Y, an exposure unit 12Y, a developing unit 100Y, a photoreceptor squeeze device 101Y, a primary transfer backup roller 51Y, an electricity removal unit 16Y, a photoreceptor cleaning blade 17Y, and a developer collecting section 18Y, and they are arranged in the named order along the rotational direction of the photoreceptor 10Y.

The photoreceptor 10Y includes a cylindrical conductive base member and a photosensitive layer (both not shown in the drawings) which is constituted of a material such as amorphous silicon or the like formed on the outer peripheral surface of the base member, and is rotatable about the axis thereof in the clockwise direction as shown by the arrow in FIG. 2.

The liquid developer is supplied onto the surface of the photoreceptor 10Y from the developing unit 100Y so that a layer of the liquid developer is formed on the surface thereof.

The electrifying roller 11Y is a device for uniformly electrifying the surface of the photoreceptor 10Y. The exposure unit 12Y is a device that forms an electrostatic latent image on the photoreceptor 10Y uniformly by means of laser beam irradiation.

The exposure unit 12Y includes a semiconductor laser, a polygon mirror, an F-θ lens, or the like, and irradiates a modulated laser beam onto the electrified photoreceptor 10Y in accordance with image signals received from a host computer such as a personal computer, a word processor or the like not shown in the drawings.

The developing unit 100Y is a device which develops the latent image to be visible with the liquid developer of the present invention. The details of the developing unit 100Y will be described later.

The photoreceptor squeeze device 101Y is disposed so as to face the photoreceptor 10Y at the downstream side of the developing unit 100Y in the rotational direction thereof. The photoreceptor squeeze device 101Y is composed from a photoreceptor squeeze roller 13Y, a cleaning blade 14Y which is press contact with the photoreceptor squeeze roller 13Y for removing a liquid developer adhering to the surface of the photoreceptor squeeze roller 13Y, and a developer collecting section 15Y for collecting the removed liquid developer.

The photoreceptor squeeze device 101Y has a function of collecting an excess carrier (insulation liquid) and a fog toner which is inherently unnecessary from the liquid developer developed by the photoreceptor 10Y thereby increasing a ratio of the toner particles in the image to be formed.

The primary transfer backup roller 51Y is a device for transferring a monochrome toner image formed on the photoreceptor 10Y to the intermediate transfer section (belt) 40.

The electricity removal unit 16Y is a device for removing a remnant charge on the photoreceptor 10Y after an intermediate image has been transferred to the intermediate transfer section 40 by the primary transfer backup roller 51Y.

The photoreceptor cleaning blade 17Y is a member made of rubber and provided in contact with the surface of the photoreceptor 10Y, and has a function of scrapping off the liquid developer remaining on the photoreceptor 10Y after the image has been transferred onto the intermediate transfer section 40 by the primary transfer backup roller 51Y.

The developer collecting section 18Y is provided for collecting the liquid developer removed by the photoreceptor cleaning blade 17Y.

The intermediate transfer section 40 is composed from an endless elastic belt which is wound around a belt drive roller 41 to which driving force is transmitted by a motor not shown in the drawings, a pair of driven rollers 44 and 45, and a tension roller 49. The intermediate transfer section 40 is rotationally driven in the anticlockwise direction by the belt drive roller 41 while being in contact with the photoreceptors 10Y, 10M, 10C and 10K at each of positions that the primary transfer backup rollers 51Y, 51C, 51M and 51K are in contact with an intermediate transfer belt (feed belt).

The intermediate transfer section 40 is constructed so that a predetermined tension is given by the tension roller 49 to prevent loosening of the endless elastic belt. The tension roller 49 is disposed at the downstream side of the intermediate transfer section 40 in the moving direction thereof with respect to one driven roller 44 and at the upstream side of the intermediate transfer section 40 in the moving direction thereof with respect to the other driven roller 45.

Monochromatic images corresponding to the respective colors formed by the developing sections 30Y, 30C, 30M and 30K are sequentially transferred by the primary transfer backup rollers 51Y, 51C, 51M and 51K so that the monochromatic images corresponding to the respective colors are overlaid, thereby enabling a full color toner image (intermediate transferred image) to be formed on the intermediate transfer section 40 which will be described later.

The intermediate transfer section 40 carries the monochromatic images formed on the respective photoreceptors 10Y, 10M, 10C and 10K in a state that these images are successively secondary-transferred onto the belt so as to be overlaid one after another, and the overlaid images are transferred onto a recoding medium F5 such as paper, film and cloth as a single color image in the secondary transfer unit 60 described later.

In the meantime, when the toner image is transferred onto the recording medium F5 in the secondary transfer process, there is a case that the recording medium F5 is not a flat sheet material due to fibers thereof. The elastic belt is employed as a means for increasing a secondary transfer characteristic for such a non-flat sheet material.

Further, the intermediate transfer section 40 is also provided with a cleaning device which is composed form an intermediate transfer section cleaning blade 46, a developer collecting section 47 and a non-contact type bias applying member 48. The intermediate transfer section cleaning blade 46 and the developer collecting section 47 are arranged on the side of the driven roller 45.

The intermediate transfer section cleaning blade 46 has a function of scrapping off of the liquid developer adhering to the intermediate transfer section 40 to remove it after the image has been transferred onto a recording medium F5 by the secondary transfer unit (secondary transfer section) 60.

The developer collecting section 47 is provided for collecting the liquid developer removed by the intermediate transfer section cleaning blade 46.

The non-contact type bias applying member 48 is disposed so as to be apart from the intermediate transfer section 40 at an opposite position of the tension roller 49 through the intermediate transfer section (that is, elastic belt) 40.

The non-contact type bias applying member 48 applies a bias voltage having a reversed polarity with respect to a polarity of the toner particles to each of the toner particles (solid content) contained in the liquid developer remaining on the intermediate transfer section 40 after the image has been secondary-transferred onto the recording medium F5.

This makes it possible to remove electricity from the remaining toner particles so that it is possible to lower electrostatic adhesion force of the toner particles to the intermediate transfer section 40. In this embodiment, a corona electrification device is used as the non-contact type bias applying member 48.

In this regard, it is to be noted that the non-contact type bias applying member 48 may not be necessarily disposed at the opposite position of the tension roller 49 through the intermediate transfer section (that is, elastic belt) 40.

For example, the non-contact type bias applying member 48 may be disposed at any position between the downstream side of the intermediate transfer section 40 in the moving direction thereof with respect to one driven roller 44 and the upstream side of the intermediate transfer section 40 in the moving direction thereof with respect to the other driven roller 45 such as any position between the driven roller 44 and the tension roller 49.

Note that as the non-contact type bias applying member 48, various known non-contact type electrification devices other than the corona electrification device may be employed.

An intermediate transfer second squeeze device 52Y is provided at the downstream side of the primary transfer backup roller 51Y in the moving direction of the intermediate transfer section 40 (see FIG. 2).

The intermediate transfer squeeze device 52Y is provided as a means for removing an excess amount of the insulation liquid from the transferred liquid developer in the case where the liquid developer transferred onto the intermediate transfer section 40 does not have a desired dispersion state.

As shown in FIG. 2, the intermediate transfer squeeze device 52Y includes an intermediate transfer squeeze roller 53Y, an intermediate transfer squeeze roller cleaning blade 55Y which is in press contact with the intermediate transfer squeeze roller 53Y for cleaning the surface thereof, and a liquid developer collecting section 56Y which collects the liquid developer removed from the intermediate transfer squeeze roller 53Y by the intermediate transfer squeeze roller cleaning blade 55Y.

The intermediate transfer squeeze device 52Y has a function of collecting an excess carrier from the liquid developer primary-transferred to the intermediate transfer section 40 to increase a ratio of the toner particles in an image to be formed and collecting a fog toner which is inherently unnecessary.

The secondary transfer unit 60 is provided with a pair of secondary transfer rollers 64 and 65 which are arranged so as to depart from each other for a predetermined distance along the moving direction of the recording medium F5.

Among the pair of the secondary transfer rollers 64 and 65, the upstream side secondary transfer roller 64 is arranged upstream side of the intermediate transfer section 40 in the rotational direction thereof. This upstream side secondary transfer roller 64 is capable of being in press contact with the belt drive roller 41 through the intermediate transfer section 40.

Among the pair of the secondary transfer rollers 64 and 65, the downstream side secondary transfer roller 65 is arranged at the downstream side of a recording medium F5 in the moving direction thereof. This downstream side secondary transfer roller 65 is capable of being in press contact to the recording medium F5 with the driven roller 44 through the intermediate transfer section 40.

Namely, intermediate transfer images which are formed on the intermediate transfer section 40 by overlaying the transferred monochromatic color images in a state that the recording medium F5 is in contact with the intermediate transfer section 40 which wound around the belt drive roller 41 and the driven roller 44 and goes through between the driven roller 44 and the downstream side secondary transfer roller 65 and between the belt driven roller 41 and the upstream side secondary transfer roller 64 are secondary-transferred on the recording medium F5.

In this case, the belt driven roller 41 and the driven roller 44 have functions as the upstream side secondary transfer roller 64 and the downstream side secondary transfer roller 65, respectively.

Namely, the belt driven roller 41 is also used as an upstream side backup roller arranged at the upstream side of the recording medium F5 to the driven roller 44 in the moving direction thereof in the secondary transfer unit 60.

The driven roller 44 is also used as a downstream side backup roller arranged in the downstream side of the recording medium F5 to the belt driven roller 41 in the moving direction thereof in the secondary transfer unit 60.

The recording medium F5 which have been conveyed to the secondary transfer unit 60 is allowed to adhere to the intermediate transfer belt at positions between the upstream side secondary transfer roller 64 and the belt driven roller 41 (nip starting position) and between the downstream side secondary transfer roller 65 and the driven roller 44 (nip ending position).

Since this makes it possible to secondary-transfer the intermediate transfer images of a full color on the intermediate transfer section 40 to the recording medium F5 with adhesion to the intermediate transfer section 40 for a predetermined period of time, it is possible to secondary-transfer the intermediate images reliably.

The secondary transfer unit 60 is provided with a secondary transfer roller cleaning blade 66 and a developer collecting section 67 with respect to the secondary transfer roller 64. The secondary transfer unit 60 is also provided with a secondary transfer roller cleaning blade 68 and a developer collecting section 69 with respect to the secondary transfer roller 65.

Each of the secondary transfer roller cleaning blades 66 and 68 is in contact with the respective secondary transfer rollers 64 and 65 to clean them. Namely, after the completion of the secondary-transfer, the liquid developer remaining on the surfaces of each of the secondary transfer rollers 64 and 65 is scrapped off by the secondary transfer roller cleaning blades 66 and 68 and removed from the secondary transfer rollers 64 and 65.

The liquid developer scrapped off from the surfaces of each of the respective secondary transfer rollers 64 and 65 by each of the secondary transfer roller cleaning blades 66 and 68 is collected and preserved by each of the developer collecting sections 67 and 69.

A toner image (transferred image or unfixed toner image) F5*a* transferred onto the recording medium F5 by the secondary transfer section 60 is fed to a fixing unit (fixing device) F40 (which will be described later), and then the unfixed toner image F5 is heated and pushed (pressed). In this way, the unfixed toner image is fixed onto the recoding medium F5.

In this regard, it is to be noted that a fixing temperature is preferably in the range of 80 to 160° C., more preferably in the range of 100 to 150° C., and even more preferably in the range of 100 to 140° C.

Next, a detailed description will be made with regard to the developing units 100Y, 100C, 100M and 100K. In this regard, it is to be noted that since the developing units 100Y, 100C, 100M and 100K have the same structure, in the following description the developing section 100Y will be representatively described.

As shown in FIG. 2, the developing unit 100Y includes a liquid developer storage section 31Y, an application roller 32Y, a regulating blade 33Y, a liquid developer stirring roller 34Y, a communicating section 35Y, a collecting screw 36Y, a developing roller 20Y, a developing roller-cleaning blade 21Y.

The liquid developer storage section 31Y is provided for storing a liquid developer for developing a latent image formed on the photoreceptor 10Y.

Such a liquid developer storage section 31Y includes a supply section 31*a*Y for supplying the liquid developer onto the application roller 32Y, a collecting section 31*b*Y for collecting an excess liquid developer in the supply section 31*a*Y, the developer collecting section 15Y and a developer collecting section 24Y and a partition 31*c*Y for partitioning between the supply section 31*a*Y and the collecting section 31*b*Y.

The supply section 31*a*Y is provided for supplying the liquid developer onto the application roller 32Y and has a concave portion in which a liquid developer stirring roller 34Y is provided. Further, the liquid developer is supplied from the liquid developer mixing bath 93Y to the supply section 31*a*Y through the communicating section 35Y.

The collecting section 31*b*Y is provided for collecting the liquid developer excessively supplied to the supply section 31*a*Y and the excess liquid developer collected in the developer collecting sections 15Y and 24Y, The collected liquid developer is fed to the liquid developer mixing bath 93Y as described later and it is then reused.

Further, the collecting section 31*b*Y has a concave portion in which the collecting screw 36Y is provided in the vicinity of a bottom thereof.

A wall-like partition 31*c*Y is provided between the supply section 31*a*Y and the collecting section 31*b*Y. The wall-like partition 31*c*Y can partition between the supply section 31*a*Y and the collecting section 31*b*Y. And the partition 31*c*Y can prevent the liquid developer collected in the developer collecting sections 15Y and 24Y from being mixed to the flesh liquid developer in the supply section 31*a*Y.

When the liquid developer is excessively supplied from the liquid developer mixing bath 93Y to the supply section 31*a*Y, the excess liquid developer is spilled from the supply section 31*a*Y into the collecting section 31*b*Y over the partition 31*c*Y.

Therefore, it is possible to maintain a constant amount of the liquid developer in the supply section 31*a*Y, thereby maintaining a constant amount of the liquid developer to be supplied to the application roller 32Y. As a result, it becomes possible to provide a constant image quality of the finally obtained images.

Further, a notch is provided in the partition 31*c*Y. The liquid developer in the supply section 31*a*Y can spill from the supply section 31*a*Y into the collecting section 31*b*Y over the notch.

The application roller 32Y has a function of supplying the liquid developer to the developing roller 20Y.

The application roller 32Y is of the type so-called as "Anilox Roller" which is constructed from a metallic roll made of iron or the like of which surface has grooves formed regularly and helically, and a nickel plating formed on the surface thereof.

The diameter of the roller is about 25 mm. As described above embodiment, in this embodiment, a number of grooves 32Y are formed inclinedly with respect to the rotational direction by means of a cutting process or rolling process.

The application roller 32Y rotates in an anti-clockwise direction and makes contact with the liquid developer so that the liquid developer stored in supply section 31*a*Y is carried by the grooves, and the carried liquid developer is then conveyed to the developing roller 20Y.

The regulating blade 33Y is provided in contact with the surface of the application roller 32Y for regulating an amount of the liquid developer carried on the application roller 32Y. Specifically, the regulating blade 33Y scrapes away an excess amount of the liquid developer on the application roller 32Y so that an amount of the liquid developer to be supplied onto the developing roller 20Y by the application roller 32Y can be regulated.

The regulating blade 33Y is formed from an elastic body made of an urethane rubber, and supported by a regulating blade supporting member made of a metal such as iron or the like. Further, the regulating blade 33Y is arranged on the side where the application roller 32Y comes out of the liquid developer with its rotation (that is, on the right side in FIG. 2).

In this regard, it is to be noted that the rubber hardness of the regulating blade 33Y, that is, a rubber hardness (77) of a portion of the regulating blade 33Y which is in press contact with the surface of the application roller 32Y is about 77 according to JIS-A.

The rubber hardness (77) of the regulating blade 33Y is lower than the rubber hardness of an elastic layer of the developing roller 20Y (described later) which is a rubber hardness (about 85) of a portion of the developing roller 20Y which is in press contact with the surface of the application roller 32Y.

Further, an excess amount of the liquid developer scraped off by the regulating blade 33Y is collected in supply section 31*a*Y and it is then reused.

The liquid developer stirring roller 34Y has a function of stirring the liquid developer so as to be homogeneously dispersed. By providing such a liquid developer stirring roller 34Y, even when a plurality of toner particles 1 are aggregated in the liquid developer storage section 31Y (supply section 31*a*Y), it is possible to disperse the plurality of toner particles 1 reliably.

The liquid developer of the present invention has superior dispersibility and redispersibility of the toner particles. Therefore, even if the liquid developer is reused, it is possible to easily disperse the toner particles in the insulation liquid.

In the supply section 31*a*Y, the plurality of toner particles 1 of the liquid developer are positively charged. The liquid developer is stirred by the liquid developer stirring roller 34Y to be a homogeneously dispersed state, and such a liquid developer is dipped from the liquid developer storage section 31Y (supply section 31*a*Y) according to the rotation of the application roller 32Y so that the liquid developer is supplied onto the developing roller 20Y with the amount of the liquid developer being regulated by the regulating blade 33Y.

Further, the stirring by the liquid developer stirring roller 34Y makes it possible to reliably supply the liquid developer in the supply section 31*a*Y to the collecting section 31*b*Y over the notch. Therefore, it is possible to prevent an excess amount of the liquid developer from remaining in the supply section 31*a*Y. It is also possible to prevent the toner particles contained in the liquid developer from aggregating in the supply section 31*a*Y.

Furthermore, the liquid developer stirring roller 34Y is provided in the supply section 31*a*Y in the vicinity of the communicating section 35Y. Therefore, it is possible to quickly diffuse the liquid developer supplied from the liquid developer mixing bath 93Y through the communicating section 35Y.

As a result, even in the case where the liquid developer is being supplied from the liquid developer mixing bath 93Y to the supply section 31*a*Y, it is possible to maintain the stable surface of the liquid developer in the supply section 31*a*Y.

Since such a liquid developer stirring roller 34Y is provided in the supply section 31*a*Y in the vicinity of the communicating section 35Y, a pressure in the supply section 31*a*Y is lower than a pressure in the liquid developer mixing bath 93Y. Therefore, the liquid developer is naturally supplied from the liquid developer mixing bath 93Y to the supply section 31*a*Y through the communicating section 35Y.

The communicating section 35Y is provided below the liquid developer stirring roller 34Y in the liquid developer storage section 31Y. Further, the communicating section 35Y is in communication with the liquid developer mixing bath 93Y through feeding means. The communicating section 35Y is a part through which the liquid developer is supplied from the liquid developer mixing bath 93Y to the supply section 31*a*Y.

Since the communicating section 35Y is provided below the liquid developer stirring roller 34Y in the liquid developer storage section 31Y, it is difficult for the liquid developer to enter into the supply section 31*a*Y through the communicating section 35Y. Therefore, no ruffle is observed on the surface of the liquid developer by the reverse flow of the liquid developer thorough the communicating section 35Y.

As a result, it is possible to maintain the stable surface of the liquid developer in the supply section 31*a*Y, thereby enabling the liquid developer to be supplied to the application roller 32Y reliably.

The collecting screw 36Y which is provided in the vicinity of the bottom of the collecting section 31*b*Y is made of a cylindrical member and has a helically rib on a outer circumferential thereof. Further, the collecting screw 36Y has a function of keeping fluidity of the liquid developer collected from the developer collecting sections 15Y and 24Y. Furthermore, the collecting screw 36Y also has a function of facilitating supply of the liquid developer to the liquid developer mixing bath 93Y.

The developing roller 20Y is provided for conveying the liquid developer to a developing position opposed to the photoreceptor 10Y in order to develop a latent image carried on the photoreceptor 10Y with the liquid developer.

The liquid developer from the application roller 32Y is supplied onto the surface of the developing roller 20Y so that a layer of the liquid developer 201Y is formed on the surface.

The developing roller 20Y includes an inner core member made of a metal such as iron or the like and an elastic layer having conductivity and provided onto an outer periphery of the inner core member. The diameter of the developing roller 20Y is about 20 mm.

The elastic layer has a two layered structure which includes an inner layer made of urethane rubber and an outer layer (surface layer) made of urethane rubber. The inner layer has a rubber hardness of 30 according to JIS-A and a thickness of about 5 mm, and the outer layer has a rubber hardness of about 85 according to JIS-A and a thickness of about 30 μm.

The developing roller 20Y is in press contact with both the application roller 32Y and the photoreceptor 10Y in a state that the outer layer of the developing roller 20Y is elastically deformed.

The developing roller 20Y is rotatable about its central axis, and the central axis is positioned below the central axis of the photoreceptor 10Y. Further, the developing roller 20Y rotates in a direction (clockwise direction in FIG. 2) opposite to the rotational direction (anti-clockwise direction in FIG. 2) of the photoreceptor 10Y.

It is to be noted that an electrical field is generated between the developing roller 20Y and the photoreceptor 10Y when a latent image formed on the photoreceptor 10Y is developed.

In this regard, it is to be noted that the application roller 32Y is driven by a power source (not shown) which is difference from a power source for driving the developing roller 20Y. Therefore, by changing a rotational speed (linear velocity) ratio of each of the application roller 32Y and the developing roller 20Y, it is possible to adjust an amount of the liquid developer to be supplied onto the developing roller 20Y.

The developing unit 100Y has a developing roller cleaning blade 21Y made of rubber and provided in contact with the surface of the developing roller 20Y and a developer collecting section 24Y. The developing roller cleaning blade 21Y is a device for scrapping off the liquid developer remaining on the developing roller 20Y after the development of an image has been carried out at the developing position. The liquid developer removed by the developing roller cleaning blade 21Y is collected in the developer collecting section 24Y.

As shown in FIG. 1 and FIG. 2, the image forming apparatus 1000 is provided with liquid developer supply sections 90Y, 90M, 90C and 90K which supply the liquid developers to the developing sections 30Y, 30M, 30C and 30K, respectively.

The liquid developer supply sections 90Y, 90M, 90C and 90K have the same structure, respectively. Namely, the liquid developer supply sections 90Y, 90M, 90C and 90K are provided with liquid developer tanks 91Y, 91M, 91C and 91K, insulation liquid tanks 92Y, 92M, 92C and 92K and liquid developer mixing baths 93Y, 93M, 93C and 93K, respectively.

In each of the liquid developer tanks 91Y, 91M, 91C and 81Y, a liquid developer of high concentration which corresponds to each of the different colors is stored. Further, in each of the insulation liquid tanks 92Y, 92M, 92C and 92K, the insulation liquid is stored.

Further, each of the liquid developer mixing baths 93Y, 93M, 93C and 93K is constructed so that a predetermined amount of the high concentration liquid developer is supplied from each of the corresponding liquid developer tanks 91Y, 91M, 91C and 91Y and a predetermined amount of the insulation liquid is supplied from each of the corresponding insulation liquid tanks 92Y, 92M, 92C and 92K.

In each of the liquid developer mixing baths 93Y, 93M, 93C and 93K, the supplied high concentration liquid developer and the supplied insulation liquid are mixed with being stirred to prepare the liquid developers corresponding to different colors which are to be used in the supply sections 31*a*Y, 31*a*M, 31*a*C and 31*a*K, respectively.

The liquid developers prepared in the respective liquid developer mixing baths 93Y, 93M, 93C and 93K in this way are supplied to the corresponding supply sections 31*a*Y, 31*a*M, 31*a*C and 31*a*K, respectively.

Further, the liquid developers collected in the respective collecting sections 31*b*Y, 31*b*M, 31*b*C and 31*b*K are respectively collected to the liquid developer mixing baths 93Y, 93M, 93C and 93K and then they are reused.

In the foregoing, the present invention was described based on the preferred embodiments, but the present invention is not limited to these embodiments.

For example, the liquid developer of the present invention is not limited to one that is to be used in the image forming apparatuses as described above.

Further, the liquid developer of the present invention is not limited to one produced by the method described above.

Further, in the above described embodiment, an electrolyte is added to the water-based dispersion liquid obtained by adding the resin solution to the aqueous solution so that the particles of the dispersoid are associated to thereby form associated particles. But the present invention is not limited thereto.

For example, a coloring agent, a monomer of a resin material, a interfacial active agent and a polymerization initiator are dispersed in the water-based liquid, and a water-based emulsion is prepared by an emulsion polymerization, and then an electrolyte is added to the water-based emulsion, so that the particles of the dispersoid are associated to thereby form associated particles (this method is called as "emulsion polymerization association method"). Further, the obtained water-based emulsion is dried by a spry to thereby obtain associated particles.

1 Production of Liquid Developer

Example 1

First, toner particles were produced. In this regard, it is to be noted that in this specification steps of the liquid developer in which a temperature is not mentioned were carried out at room temperature (25° C.)

Step of Preparing Dispersion Liquid

Preparation of Coloring Agent Master Batch

First, a polyester resin (acid value thereof was 10 mgKOH/g, glass transition point (Tg) thereof was 46.3° C., and softening point thereof was 95.0° C.) and a cyan type pigment ("Pigment Blue 15:3" produced by Dainichiseika Color & Chemicals Mfg. Co., Ltd.) as a coloring agent were prepared. These components were mixed at a mass ratio of 50:50 using a 20 L type Henschel mixer to obtain a material for producing toner particles.

Next, the material (mixture) was kneaded using a biaxial kneader-extruder. The kneaded material extruded from an extruding port of the biaxial kneader-extruder was cooled. The kneaded material that had been cooled as described above was coarsely ground using a hammer mill to be formed into powder constituting a coloring agent master batch which had an average particle size of 1.0 mm or less.

Methylethylketone was added to the powder of the kneaded material obtained so that an amount of the powder of the kneaded material (polyester resin and pigment) became 30 wt % and then the mixture was subjected to a wet dispersion process with an aigar motor mill ("M-1000" produced by American Aigar Co., Ltd.) to prepare the coloring agent master batch.

Preparation of Resin Solution

Next, 42.6 parts by weight of methylethylketone, 124.3 parts by weight of the polyester resin described above, and 1.1 parts by weight of NEOGEN SC-F as an emulsifying agent (produced by DAI-ICHI KOGYO SEIYAKU Co., LTD.) were added into a flask in which 132 parts by weight of the coloring agent master batch was contained to obtain a mixture and then the mixture was stirred with a high speed disperser ("T.K. ROBOMIX/T.K. HOMO DISPER MODEL 2.5" produced by PRIMIX Corporation, which are the registered trademarks). In this way, a resin solution was obtained. In the resin solution, the pigment was finely dispersed homogeneously.

Formation of Dispersoid

Next, 50 parts by weight of 1N ammonia water was added to the resin solution in the flask to obtain a mixture. Then, the mixture was sufficiently stirred by a high speed disperser ("T.K. ROBOMIX/T.K. HOMO DISPER MODEL 2.5" produced by PRIMIX Corporation, which are the registered trademarks) under the conditions that a rotational velocity of a tip of a stirring blade thereof was 7.5 m/s.

Thereafter, 170 parts by weight of deionized water was added into the mixture in the flask drop by drop under the conditions that the temperature of the mixture in the flask was adjusted at 25° C. and the mixture was stirred at 14.7 m/s of the rotational velocity of the tip of the stirring blade to thereby cause phase inversion emulsification.

Thereafter, 70 parts by weight of deionized water was added into the mixture in the flask while stirring the mixture. In this way, a water-based dispersion liquid in which a dispersoid composed of the resin material was dispersed was obtained.

Associated Particle Formation Step

Next, the water-based dispersion liquid was put into a stirring flask having a maxblend stirring blade. Then, the water-based dispersion liquid was continued to be stirred under the conditions that the temperature of the water-based dispersion liquid in the stirring flask was adjusted at 25° C. and the water-based dispersion liquid was stirred at 1.0 m/s of the rotational velocity of the tip of the stirring blade.

Thereafter, 300 parts by weight of 5.0% ammonium sulfate solution was added into the water-based dispersion liquid drop by drop under the same conditions as described above to produce associated particles by associating fine particles of the dispersoid in the water-based dispersion liquid.

After the addition of the ammonium sulfate solution to the water-based dispersion liquid was ended, the water-based dispersion liquid was still continued to be stirred until the average particle size (the volume median diameter Dv (50)) of the associated particles became 3 μm to obtain an associated particle dispersion liquid.

Thereafter, 120.6 parts by weight of deionized water was added into the associated particle dispersion liquid. In this way, the production process of the associated particles was completed.

Step of Removing Solvent in Associated Particle Dispersion Liquid

The associated particle dispersion liquid was dried under reduced pressure to remove the organic solvent (methylethylketone) so that an amount of a solid content in the associated particle dispersion liquid became 23 wt % and to thereby obtain a slurry containing the associated particles of the dispersoid.

Step of Washing

Next, by repeatedly carrying out the process that the slurry was separated into a solid content and a liquid content and then the solid content separated from the slurry was dispersed into deionized water to thereby obtain a slurry, the associated particles were washed. Thereafter, by using a suction filtration method, a wet cake containing the resin material and the coloring agent was obtained. In this regard, an amount of moisture content in the wet cake was 35 wt %.

Step of Drying

Next, the wet cake was dried by using a vacuum drier to thereby obtain toner particles.

Dispersion Step 100 parts by weight of the thus obtained toner particles, 1.25 parts by weight of Solsperse 13940 (produced by Lubrizol Japan Ltd.) as a dispersant, 1.25 parts by weight of the compound represented by the chemical formula (I) ("AMINE O" is a product name, produced by Nihon Ciba-Geigy K.K.) as a charge control agent, 240 parts by weight of a rape oil ("high-oleic rape oil" produced by The Nisshin OilliO Group, Ltd.), and 160 parts by weight of a soy oil fatty acid methyl (produced by The Nisshin OilliO Group, Ltd.) were put into a ceramics pot (the size of the ceramic pot was 600 ml), and then zirconia balls each having a diameter of 1 mm were added in the ceramics pot so that a volume filling factor thereof became 85%.

In this regard, it is to be noted that in the compound represented by the chemical formula (I) (AMINE O), R1 represents an alkenyl group of $C_{17}H_{33}$— (the carbon of 8-position in the alkenyl group has a double bond) and R2 represents —$CH_2CH_2OH$.

They were then mixed by a desk pot mill at a rotational speed of 220 rpm for 48 hours, to thereby obtain a liquid developer in which the toner particles were dispersed in the insulation liquid.

The average particle size (the volume median diameter Dv (50)) of the thus obtained toner particles was 2.5 μm. In this regard, it is to be noted that an average particle size of the associated particles and an average particle size of the toner particles obtained in each of the Examples 1 to 12 and the Comparative Examples 1 to 4 were measured in the volume basis with a particle analysis apparatus ("Mastersizer 2000" produced by Malvern Instruments Ltd.).

Furthermore, a magenta liquid developer, a yellow liquid developer, and a black liquid developer which were the same as those described above were produced excepting that Pigment Red 122 (produced by Sanyo Color Works) as a magenta pigment, Pigment Yellow 180 (Clariant K.K.) as a yellow pigment, and a carbon black ("Printex L", produced by Degussa AG) as a black pigment were respectively used instead of the cyanine pigment.

Examples 2 to 5

In each of the Examples 2 to 5, liquid developers of respective colors were produced in the same manner as in the Example 1 except that the amount of the charge control agent was changed to that as shown in Table 1.

Example 6

Liquid developers of respective colors were produced in the same manner as in the Example 1 except that the dispersant was changed to Solsperse 11200 (produced by Lubrizol Japan Ltd.).

Examples 7 and 8

In each of the Examples 7 and 8, liquid developers of respective colors were produced in the same manner as in the Example 1 except that the amount of the dispersant was changed to that as shown in Table 1.

Example 9

Liquid developers of respective colors were produced in the same manner as in the Example 1 except that both the rape oil and the soy oil fatty acid methyl were changed to ISOPAR H which is a product name of Exxon Mobil.

Example 10

Liquid developers of respective colors were produced in the same manner as in the Example 1 except that the charge control agent represented by the chemical formula (I) was changed to Disperbyk-109 (produced by BYK Japan KK).

In this regard, it is to be noted that in a compound represented by the chemical formula (I), namely Disperbyk-109, R1 represents an alkenyl group and R2 represents —$CH_2CH_2OH$.

Example 11

Liquid developers of respective colors were produced in the same manner as in the Example 10 except that the dispersant was changed to Solsperse 11200 (produced by Lubrizol Japan Ltd.).

Example 12

Liquid developers of respective colors were produced in the same manner as in the Example 10 except that both the rape oil and the soy oil fatty acid methyl were changed to ISOPAR H which is a product name of Exxon Mobil.

Comparative Example 1

Liquid developers of respective colors were produced in the same manner as in the Example 1 except that the charge control agent was not used.

Comparative Example 2

Liquid developers of respective colors were produced in the same manner as in the Example 1 except that the dispersant was not used.

Comparative Example 3

Liquid developers of respective colors were produced in the same manner as in the Example 1 except that the charge control agent was changed to a metallic soap (stearic zinc) and the amount of the charge control agent was changed to that shown in Table 1.

Comparative Example 4

Liquid developers of respective colors were produced in the same manner as in the Example 1 except that the charge control agent was changed to a metallic soap (Nikka octic Zirconium which was produced by NIHON KAGAKU SANGYO CO., LTD., namely a compound containing octylic zirconium) and the amount of the charge control agent was changed to that shown in Table 1.

With respect to the liquid developers of the Examples 1 to 12 and the Comparative Examples 1 to 4, the composition and physical properties of each of the liquid developers are shown in Table 1.

In Table 1, it is to be noted that the polyester resin is shown as "PES". Further, it is also to be noted that AMINE O is shown as "AO", Disperbyk-109 is shown as "D109", stearic zinc is shown as "AZ", and Nikka Octic Zirconium is shown as "OZ". Furthermore, it is also to be noted that Solsperse 13940 is shown as "13940", Solsperse 11200 is shown as "11200". Furthermore, it is also to be noted that the soy oil fatty acid methyl is shown as "MONO", the rape oil is shown as "VO", and ISOPAR H is shown as "AH".

Thereafter, the adhesive tapes carrying the toner particles thereon were attached to recording papers so as to transfer the toner particles to each of the recording papers. And then, an amount of the toner particles attached to each of the adhesive tapes was measured using the recording papers.

TABLE 1

| | Liquid developer | | | | | | | | | | | |
|---|---|---|---|---|---|---|---|---|---|---|---|---|
| | Toner particles | | | | Charge control agent | | Dispersant | | Insulation liquid | | | |
| | Kind | Acid number [mgKOH/g] | Glass transition temperature Tg[° C.] | Softening temperature T1/2[° C.] | Kind | Amount of charge control agent to 100 part by weight of toner particles (parts by weight) | Kind | Amount of dispersant to 100 parts by weight of toner particles (parts by weight) | Kind | Amount in insulation liquid [wt %] | Kind | Amount in insulation liquid [wt %] |
| Ex. 1 | PES | 10 | 46.3 | 95.0 | AO | 1.25 | 13940 | 1.25 | VO | 60 | MONO | 40 |
| Ex. 2 | PES | 10 | 46.3 | 95.0 | AO | 0.5 | 13940 | 1.25 | VO | 60 | MONO | 40 |
| Ex. 3 | PES | 10 | 46.3 | 95.0 | AO | 2 | 13940 | 1.25 | VO | 60 | MONO | 40 |
| Ex. 4 | PES | 10 | 46.3 | 95.0 | AO | 2.5 | 13940 | 1.25 | VO | 60 | MONO | 40 |
| Ex. 5 | PES | 10 | 46.3 | 95.0 | AO | 5 | 13940 | 1.25 | VO | 60 | MONO | 40 |
| Ex. 6 | PES | 10 | 46.3 | 95.0 | AO | 1.25 | 11200 | 1.25 | VO | 60 | MONO | 40 |
| Ex. 7 | PES | 10 | 46.3 | 95.0 | AO | 1.25 | 13940 | 2.5 | VO | 60 | MONO | 40 |
| Ex. 8 | PES | 10 | 46.3 | 95.0 | AO | 1.25 | 13940 | 5 | VO | 60 | MONO | 40 |
| Ex. 9 | PES | 10 | 46.3 | 95.0 | AO | 1.25 | 13940 | 1.25 | AH | 100 | — | — |
| Ex. 10 | PES | 10 | 46.3 | 95.0 | D109 | 1.25 | 13940 | 1.25 | VO | 60 | MONO | 40 |
| Ex. 11 | PES | 10 | 46.3 | 95.0 | D109 | 1.25 | 11200 | 1.25 | VO | 60 | MONO | 40 |
| Ex. 12 | PES | 10 | 46.3 | 95.0 | D109 | 1.25 | 13940 | 1.25 | AH | 100 | — | — |
| Comp. Ex. 1 | PES | 10 | 46.3 | 95.0 | — | — | 13940 | 1.25 | VO | 60 | MONO | 40 |
| Comp. Ex. 2 | PES | 10 | 46.3 | 95.0 | AO | 1.25 | — | — | VO | 60 | MONO | 40 |
| Comp. Ex. 3 | PES | 10 | 46.3 | 95.0 | AZ | 2.5 | 13940 | 1.25 | VO | 60 | MONO | 40 |
| Comp. Ex. 4 | PES | 10 | 46.3 | 95.0 | OZ | 2.5 | 13940 | 1.25 | VO | 60 | MONO | 40 |

2 Evaluation

For the respective liquid developers produced as described above, the following evaluations were made.

2.1 Developing Efficiency

By using the image forming apparatus shown in FIG. 1 and in FIG. 2, a layer of a liquid developer was formed on the surface of the developing roller of the image apparatus using each of the liquid developers of different colors of the Examples 1 to 12 and the Comparative Examples 1 to 4, respectively.

Next, in the image forming apparatus in which the layer of the liquid developer was formed, the surface potential of the developing roller and the surface potential of the photoreceptor were respectively electrified at a voltage of 300V and a voltage of 500V uniformly. Thereafter, the photoreceptor was exposed so that the surface potential of the photoreceptor was decreased to a voltage of 50V to form a latent image on the photoreceptor.

Thereafter, the layer of the liquid developer formed on the surface of the developing roller was made to be passed between the developing roller and the photoreceptor so that a part of the toner particles of the liquid developer was transferred from the developing roller onto the photoreceptor to develop the latent image on the outer peripheral surface of the photoreceptor.

Then, the toner particles remaining on the outer peripheral surface of the developing roller and the toner particles transferred on the outer peripheral surface of the photoreceptor were picked up by attaching adhesive tapes to the outer peripheral surface of the developing roller and the outer peripheral surface of the photoreceptor, respectively.

Based on the measurement values, a developing efficiency of each of the liquid developers was calculated and the calculated results were evaluated according to the following four criteria A to D. Here, the developing efficiency is defined by a value obtained by dividing the amount of the toner particles picked up from the photoreceptor by the sum of both the amount of the toner particles picked up from the photoreceptor and the amount of the toner particles picked up from the developing roller and further multiplying by 100.

A: Developing efficiency was 95% or higher, and the developing efficiency was very good.

B: Developing efficiency was 90% or higher but lower than 95%, and the developing efficiency was good.

C: Developing efficiency was 80% or higher but lower than 90%, and the developing efficiency was normal in practical use.

D: Developing efficiency was lower than 80%, and the developing efficiency was bad.

2.2 Transferring Efficiency

By using the image forming apparatus shown in FIG. 1 and in FIG. 2 a layer of a liquid developer was formed on the surface of the photoreceptor of the image apparatus using each of the liquid developers of different colors of the Examples 1 to 12 and the Comparative Examples 1 to 4, respectively.

Thereafter, the layer of the liquid developer formed on the outer peripheral surface of the photoreceptor was made to be passed between the photoreceptor and the intermediate transfer section so that the toner particles were transferred from the photoreceptor onto the intermediate transfer section.

Then, the toner particles remaining on the outer peripheral surface of the photoreceptor and the toner particles transferred onto the outer peripheral surface of the intermediate transfer section were picked up by attaching adhesive tapes to the outer peripheral surface of the photoreceptor and the outer peripheral surface of the intermediate transfer section, respectively.

Thereafter, the adhesive tapes carrying the toner particles were attached to recording papers so as to transfer the toner particles to each of the recording papers. And then, an amount of the toner particles attached to each of the adhesive tapes was measured using the recording papers.

Based on the measurement values, a transferring efficiency was calculated and the calculated results were evaluated according to the following four criteria A to D. Here, the transferring efficiency is defined by a value obtained by dividing the amount of the toner particles picked up from the intermediate transfer section by the sum of both the amount of the toner particles picked up from the intermediate transfer section and the amount of the toner particles picked up from the photoreceptor and further multiplying by 100.

A: Transferring efficiency was 95% or higher, and the transferring efficiency was very good.

B: Transferring efficiency was 90% or higher but lower than 95%, and the transferring efficiency was good.

C: Transferring efficiency was 80% or higher but lower than 90%, and the transferring efficiency was normal in practical use.

D: Transferring efficiency was lower than 80%, and the transferring efficiency was bad.

2.3 Positively Charge Property

Potential differences of the liquid developers of different colors obtained in the Examples 1 to 12 and the Comparative Examples 1 to 4 were measured by using a microscope type laser zeta potential meter (ZC-2000 produced by Microtec Nition Corporation), and the measurement results were evaluated according to the following five criteria A to E. In this regard, it is to be noted that zeta potential of each liquid developer was measured as follows.

First, each liquid developer was diluted with a solvent, and then each diluted liquid developer was put in a transparent cell having a diameter of 10 mm. Next, the transparent cell was set to the microscope type laser zeta potential meter, and then a voltage of 300 V was applied between electrodes (interval therebetween was 9 mm) of the microscope type laser zeta potential meter.

At the same time, movement of the toner particles was observed with a microscope to calculate their moving speed by the microscope type laser zeta potential meter, and zeta potential of each liquid developer was obtained based on the calculated moving speed values.

A: Potential difference was +150 mV or higher (very good).

B: Potential difference was +125 mV or higher but lower than +150 mV (good).

C: Potential difference was +100 mV or higher but lower than +125 mV (normal).

D: Potential difference was +75 mV or higher but lower than +100 mV (bad).

E: Potential difference was lower than +75 mV (very bad).

2.4 Dispersibility Test

The liquid developer of 10 ml obtained in each of the Examples 1 to 12 and the Comparative Examples 1 to 4 was supplied to a test tube (bore diameter thereof was 12 mm, and length thereof was 120 mm). After the liquid developer in the test tube was being placed in static condition for a week, a settling depth of the toner particles in each test tube was measured and the measured results were evaluated according to the following four criteria A to D.

A: Settling depth of toner particles was 0 mm.

B: Settling depth of toner particles was 0 mm or higher but lower than 2 mm.

C: Settling depth of toner particles was 2 mm or higher but lower than 5 mm.

D: Settling depth of toner particles was 5 mm or higher.

These results are shown in the following Table 2.

TABLE 2

| | Developing efficiency | Transferring efficiency | Positively charge property | Dispersibility |
|---|---|---|---|---|
| Ex. 1 | A | A | A | A |
| Ex. 2 | B | A | B | A |
| Ex. 3 | A | A | A | A |
| Ex. 4 | B | B | B | A |
| Ex. 5 | C | B | B | A |
| Ex. 6 | A | A | A | A |
| Ex. 7 | A | A | A | A |
| Ex. 8 | A | A | A | A |
| Ex. 9 | B | B | B | A |
| Ex. 10 | A | A | A | A |
| Ex. 11 | A | A | A | A |
| Ex. 12 | B | B | B | A |
| Comp. Ex. 1 | D | D | E | A |
| Comp. Ex. 2 | C | D | C | D |
| Comp. Ex. 3 | D | D | D | A |
| Comp. Ex. 4 | D | D | D | A |

As shown in the Table 2, the liquid developers according to the present invention (that is, the liquid developers of the Examples 1 to 12) had excellent developing efficiency, transferring efficiency, a charge property (positive charge property) and dispersibility of the toner particles. In contrast, in the liquid developers of different colors of the Comparative Examples 1 to 4, satisfactory results could not be obtained.

3 Production of Liquid Developer

Example 13

First, toner particles were produced. In this regard, it is to be noted that in this specification steps of the liquid developer in which a temperature is not mentioned were carried out at room temperature (25° C.).

Step of Preparing Dispersion Liquid

Preparation of Coloring Agent Master Batch

First, a mixture of 48 parts by weight of a polyester resin L1 (acid value thereof was 8.5 mgKOH/g, weight-average molecular weight Mw thereof was 5,200, glass transition temperature Tg thereof was 46° C., and softening point T1/2 thereof was 95° C.) as a first polyester resin having a low molecular weight and 12 parts by weight of a polyester resin H2 (acid value thereof was 16.0 mgKOH/g, weight-average molecular weight Mw thereof was 237,000, glass transition temperature Tg thereof was 63° C., and softening point T1/2 thereof was 182° C.) as a second polyester resin having a high molecular weight were prepared as a polyester resin.

Next, the mixture of the polyester resins (the first polyester resin and the second polyester resin) and a cyanine pigment ("Pigment Blue 15:3", produced by Dainichiseika Color & Chemicals Mfg. Co., Ltd.) as a coloring agent were prepared. These components were mixed at a mass ratio of 50:50 using a 20 L type Henschel mixer to obtain a material for producing toner particles.

Next, the material (mixture) was kneaded using a biaxial kneader-extruder. The kneaded material extruded from an extruding port of the biaxial kneader-extruder was cooled.

The kneaded material that had been cooled as described above was coarsely ground using a hammer mill to be formed into powder constituting a coloring agent master batch which had an average particle size of 1.0 mm or less.

Methylethylketone was added to the powder of the kneaded material obtained so that an amount of the powder of the kneaded material (polyester resin and pigment) became 30 wt % and then the mixture was subjected to a wet dispersion process with an aigar motor mill ("M-1000" produced by American Aigar Co., Ltd.) to prepare the coloring agent master batch. In this way, the coloring agent master batch was obtained.

Preparation of Resin Solution

Next, 42.6 parts by weight of methylethylketone, 124.3 parts by weight of the mixture of the polyester resins described above, and 1.1 parts by weight of NEOGEN SC-F (an emulsifying agent produced by DAI-ICHI KOGYO SEIYAKU Co., LTD.) were added into a flask in which 132 parts by weight of the coloring agent master batch to obtain a mixture, and then the mixture was stirred with a high speed disperser ("T.K. ROBOMIX/T.K. HOMO DISPER MODEL 2.5" produced by PRIMIX Corporation, which are the registered trademarks) to obtain a resin solution. In the resin solution, the pigment was finely dispersed homogeneously.

Formation of Dispersoid

Next, 50 parts by weight of 1N ammonia water was added to the resin solution in the flask to obtain a mixture. Then, the mixture was sufficiently stirred by a high speed disperser ("T.K. ROBOMIX/T.K. HOMO DISPER MODEL 2.5" produced by PRIMIX Corporation, which are the registered trademarks) under the conditions that a rotational velocity of a tip of a stirring blade thereof was 7.5 m/s.

Thereafter, 170 parts by weight of deionized water was added into the mixture in the flask drop by drop under the conditions that the temperature of the mixture in the flask was adjusted at 25° C. and the mixture was stirred at 14.7 m/s of the rotational velocity of the tip of the stirring blade to thereby cause phase inversion emulsification.

Thereafter, 70 parts by weight of deionized water was added into the mixture in the flask while stirring the mixture. In this way, a water-based dispersion liquid in which a dispersoid composed of the resin material was dispersed was obtained.

Associated Particle Formation Step

Next, the water-based dispersion liquid was put into a stirring flask having a maxblend stirring blade. Then, the water-based dispersion liquid was continued to be stirred under the conditions that the temperature of the water-based dispersion liquid in the stirring flask was adjusted at 25° C. and the water-based dispersion liquid was stirred at 1.0 m/s of the rotational velocity of the tip of the stirring blade.

Thereafter, 300 parts by weight of 5.0% ammonium sulfate solution was added into the water-based dispersion liquid drop by drop under the same conditions as described above to produce associated particles by associating fine particles of the dispersoid in the water-based dispersion liquid.

After the addition of the ammonium sulfate solution to the water-based dispersion liquid was ended, the water-based dispersion liquid was still continued to be stirred until the average particle size (the volume median diameter Dv (50)) of the associated particles became 3 μm to obtain an associated particle dispersion liquid.

Thereafter, 120.6 parts by weight of deionized water was added into the associated particle dispersion liquid. In this way, the production process of the associated particles was completed.

Step of Removing Solvent in Associated Particle Dispersion Liquid

The associated particle dispersion liquid was dried under reduced pressure to remove the organic solvent (methylethylketone) so that an amount of a solid content in the associated particle dispersion liquid became 23 wt % and to thereby obtain a slurry containing the associated particles of the dispersoid.

Step of Washing

Next, by repeatedly carrying out the process that the slurry was separated into a solid content and a liquid content and then the solid content separated from the slurry was dispersed into deionized water to thereby obtain a slurry, the associated particles were washed. Thereafter, by using a suction filtration method, a wet cake containing the resin material and the coloring agent was obtained. In this regard, an amount of moisture content in the wet cake was 35 wt %.

Step of Drying

Next, the wet cake was dried by using a vacuum drier to thereby obtain toner particles.

Dispersion Step 100 parts by weight of the thus obtained toner particles, 1.25 parts by weight of Solsperse 13940 (produced by Lubrizol Japan Ltd.) as a dispersant, 1.25 parts by weight of the compound represented by the chemical formula (I) ("AMINE O" is a product name, produced by Nihon Ciba-Geigy K.K.) as a charge control agent, 240 parts by weight of a rape oil ("high-oleic rape oil" produced by The Nisshin OilliO Group, Ltd.), and 160 parts by weight of a soy oil fatty acid methyl (produced by The Nisshin OilliO Group, Ltd.) were put into a ceramics pot (the size of the ceramic pot was 600 ml), and then zirconia balls each having a diameter of 1 mm were added in the ceramics pot so that a volume filling factor thereof became 85%.

In this regard, it is to be noted that in the compound represented by the chemical formula (I) (AMINE O), R1 represents an alkenyl group of $C_{17}H_{33}$— (the carbon of 8-position in the alkenyl group has a double bond) and R2 represents —$CH_2CH_2OH$.

They were then mixed by a desk pot mill at a rotational speed of 220 rpm for 48 hours, to thereby obtain a liquid developer in which the toner particles were dispersed in the insulation liquid.

The average particle size (the volume median diameter Dv (50)) of the thus obtained toner particles was 2.6 μm. In this regard, it is to be noted that an average particle size of the associated particles and an average particle size of the toner particles obtained in each of the Examples 1 to 12 and the Comparative Examples 1 to 4 were measured in the volume basis with a particle analysis apparatus ("Mastersizer 2000" produced by Malvern Instruments Ltd.).

Furthermore, a magenta liquid developer, a yellow liquid developer, and a black liquid developer which were the same as those described above were produced excepting that Pigment Red 122 (produced by Sanyo Color Works) as a magenta pigment, Pigment Yellow 180 (Clariant K.K.) as a yellow pigment, and a carbon black ("Printex L", produced by Degussa AG) as a black pigment were respectively used instead of the cyanine pigment.

Example 14

Liquid developers of different colors were produced in the same manner as in the Example 13 except that the polyester resin L1 was changed to the polyester resin L2 as a first polyester resin shown in Table 3 and the polyester resin H1 was changed to the polyester resin H2 as a second polyester resin shown in Table 3.

Example 15

Liquid developers of different colors were produced in the same manner as in the Example 13 except that the polyester resin L1 and the polyester resin H1 were respectively changed to the polyester resin L3 as a first polyester resin and the polyester resin H3 as a second polyester resin shown in Table 3, and the ratio thereof in the resin material were changed to that shown in Table 4.

With respect to the Examples 13 to 15, a weight ratio between terephthalic acid (TPA) and isophtalic acid (IPA) in the monomer components to synthesize the polyester resins (first polyester resin L1-L3 and second polyester resin H1-H3), a weight ratio between ethylene glycol (EG) and neo-pentyl glycol (NPG) in the monomer components to synthesize the polyester resins (first polyester resin L1-L3 and second polyester resin H1-H3) and the like are shown in Table 3.

Further, the glass transition temperature Tg, the softening point T1/2, the weight-average molecular weight Mw and acid values of the respective polyester resins are shown in Table 3.

Furthermore, the glass transition temperatures Tg of the first polyester resin and the second polyester resin in Table 3 were measured under the following conditions by using DSC ("DSC-220C" produced by Seiko Instruments Inc.) as a measurement apparatus. The conditions were set so that 10 mg of the resin material was added to an aluminum pan, a temperature raising speed was 10° C./min and a measurement temperature was in the range of 30 to 150° C.

The measurement was carried out two times under the same conditions. The first round of the measurement was carried out at a raising and falling temperature of 10° C. to 150° C. to 10° C. The second round of the measurement was carried out under the same conditions as those of the first round of the measurement. In this regard, it was to be noted that the data of the second round of the measurement was used as each of the glass transition temperatures in Table 3.

Further, it is to be noted that the softening point T1/2 of each of the polyester resin in Table 3 was measured under the conditions that a temperature raising speed is 5° C./min and a diameter of a die hole is 1.0 mm in a high-floored flow tester (produced by Shimadzu Corporation) as a measurement apparatus.

With respect to the liquid developers of the Examples 13 to 15, the composition and the physical properties of each of the liquid developers, and the like are shown in Table 4.

In Table 3 and Table 4, it is also to be noted that the polyester resin L1 as the first polyester resin is shown as "L1", the polyester resin L2 as the first polyester resin is shown as "L2", and the polyester resin L3 as the first polyester resin is shown as "L3".

Further, in Table 3 and Table 4, it is also to be noted that the polyester resin H1 as the second polyester resin is shown as "H1", the polyester resin H2 as the second polyester resin is shown as "H2" and the polyester resin H3 as the second polyester resin is shown as "H3".

Further, in Table 4, it is also to be noted that AMINE O is shown as "AO", Solsperse 13940 is shown as "13940", the soy oil fatty acid methyl is shown as "MONO", and the rape oil is shown as "VO".

TABLE 3

| | | Resin L1 | Resin L2 | Resin L3 | Resin H1 | Resin H2 | Resin H3 |
|---|---|---|---|---|---|---|---|
| Use ratio between first monomer component and second monomer component (parts by weight) | TPA:IPA | 40:60 | 60:40 | 80:20 | 70:30 | 70:30 | 74.5:25.3 |
| | EG:NPG | 50:50 | 50:50 | (100:0) | 60:40 | 60:40 | (100:0) |
| | W(EG)/W(NPG) | 1.0 | 1.0 | — | 1.5 | 1.5 | — |
| Characteristics | Glass transition temperature Tg[° C.] | 46 | 37 | 56 | 63 | 63 | 65 |
| | Softening temperature T1/2[° C.] | 95 | 90 | 110 | 182 | 175 | 175 |
| | Mw | 5,200 | 3,900 | 8,900 | 237,000 | 359,900 | 78,000 |
| | Acid number [mgKOH/g] | 8.5 | 6.8 | 6.9 | 16.0 | 11.0 | 10.0 |

TABLE 4

| | Liquid developer | | | | | | | | | | | |
|---|---|---|---|---|---|---|---|---|---|---|---|---|
| | Toner particles Resin material | | | | | | | | | | | |
| | Polyester resin having low molecular weight (first polyester resin) | | Polyester resin having high molecular weight (second polyester resin) | | Charge control agent | | Dispersant | | Insulation liquid | | | |
| | Kind | Amount of first polyester resin in resin material [wt %] | Kind | Amount of second polyester resin in resin material [wt %] | Kind | Amount of charge control agent to 100 parts by weight of toner particles (parts by weight) | Kind | Amount of dispersant to 100 parts by weight of toner particles (parts by weight) | Kind | Amount in insulation liquid [wt %] | Kind | Amount in insulation liquid [wt %] |
| Ex. 13 | L1 | 80 | H1 | 20 | AO | 1.25 | 13940 | 1.25 | VO | 60 | MONO | 40 |
| Ex. 14 | L2 | 80 | H2 | 20 | AO | 1.25 | 13940 | 1.25 | VO | 60 | MONO | 40 |
| Ex. 15 | L3 | 60 | H3 | 40 | AO | 1.25 | 13940 | 1.25 | VO | 60 | MONO | 40 |

For the respective liquid developers produced as described above, evaluations which were the same as, the evaluations described above [2] were made. Further, these results are shown in the following Table 5.

TABLE 5

| | Developing efficiency | Transferring efficiency | Positively charge property | Dispersibility |
|---|---|---|---|---|
| Ex. 13 | A | A | A | A |
| Ex. 14 | A | A | A | A |
| Ex. 15 | A | A | A | A |

As shown in the Table 5, the liquid developers according to the present invention (that is, the liquid developers of the Examples 13 to 15) had excellent developing efficiency, transferring efficiency, charge property (positive charge property) and dispersibility of the toner particles.

What is claimed is:

1. A liquid developer, comprising:

an insulation liquid;

toner particles dispersed in the insulation liquid and each formed of a material containing a polyester resin, the polyester resin containing a low molecular weight polyester resin having a weight-average molecular weight $Mw_1$ of 3,000 to 12,000 and a high molecular weight polyester resin having a weight-average molecular weight $Mw_2$ of 20,000 to 400,000;

a dispersant dissolved in the insulation liquid and including a polymer dispersant having a 12-hydroxystearic skeleton in a chemical structure thereof; and a charge control agent dissolved in the insulation liquid;

wherein the charge control agent is represented by the following chemical formula (I):

(I)

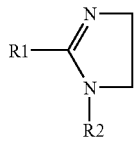

wherein in the chemical formula (I) R1 represents an alkyl group or alkenyl group having a carbon number in the range of 8 to 22, and R2 represents a hydroxyalkyl group.

2. The liquid developer as claimed in claim 1, wherein the hydroxyalkyl group represented by R2 in the chemical formula (I) has a carbon number in the range of 1 to 4.

3. The liquid developer as claimed in claim 1, wherein the insulation liquid contains a vegetable oil.

4. The liquid developer as claimed in claim 1, wherein the insulation liquid contains a fatty acid monoester.

* * * * *